US011654075B2

(12) United States Patent
Franklin et al.

(10) Patent No.: US 11,654,075 B2
(45) Date of Patent: May 23, 2023

(54) METHOD AND APPARATUS FOR UPGRADING A PATIENT SUPPORT APPARATUS TO INCLUDE AN INTEGRATED PATIENT THERAPY DEVICE

(71) Applicant: Hill-Rom Services, Inc., Batesville, IN (US)

(72) Inventors: Taylor Franklin, Batesville, IN (US); James L. Walke, Batesville, IN (US); Kenneth L. Lilly, West Chester, OH (US)

(73) Assignee: Hill-Rom Sevices, Inc., Batesville, IN (US)

( * ) Notice: Subject to any disclaimer, the term of this patent is extended or adjusted under 35 U.S.C. 154(b) by 461 days.

(21) Appl. No.: 16/829,507

(22) Filed: Mar. 25, 2020

(65) Prior Publication Data

US 2020/0306129 A1 Oct. 1, 2020

Related U.S. Application Data

(60) Provisional application No. 62/826,719, filed on Mar. 29, 2019.

(51) Int. Cl.

| | |
|---|---|
| ***A61H 9/00*** | (2006.01) |
| ***A61G 7/05*** | (2006.01) |
| ***A47C 21/00*** | (2006.01) |

(52) U.S. Cl.

CPC ..... *A61H 9/0092* (2013.01); *A47C 21/00* (2013.01); *A61G 7/0503* (2013.01); *A61H 2201/0142* (2013.01); *A61H 2205/106* (2013.01)

(58) Field of Classification Search

CPC ..... A61H 9/0092; A61H 2201/0142; A61H 2205/106; A61G 7/0503; A61G 7/05; A47C 21/00; A47C 31/00

USPC ..... 5/655.3, 654, 644, 658, 503.1; 601/149, 601/148

See application file for complete search history.

(56) References Cited

U.S. PATENT DOCUMENTS

| | | | | |
|---|---|---|---|---|
| 4,259,755 A * | 4/1981 | Hollander | A47C 13/005 | 5/2.1 |
| 4,262,872 A * | 4/1981 | Kodet | A61G 1/04 | 5/503.1 |
| 5,094,418 A * | 3/1992 | McBarnes, Jr. | A61G 7/0503 | 248/308 |
| 5,876,359 A * | 3/1999 | Bock | A61H 9/0078 | 601/150 |
| 6,467,111 B1 * | 10/2002 | Vrzalik | A61G 7/05784 | 5/423 |
| 6,684,432 B2 * | 2/2004 | Owens, Jr. | A47C 27/00 | 5/931 |
| 6,829,796 B2 * | 12/2004 | Salvatini | A61G 7/0513 | 5/713 |

(Continued)

FOREIGN PATENT DOCUMENTS

| | | | |
|---|---|---|---|
| EP | 3207911 A1 * | 8/2017 | A47C 21/042 |
| EP | 3207911 B1 * | 4/2019 | A47C 21/042 |

(Continued)

*Primary Examiner* — Robert G Santos

(74) *Attorney, Agent, or Firm* — Barnes & Thornburg LLP

(57) ABSTRACT

A therapy system includes a patient support apparatus and a pneumatic therapy device that is coupleable to the patient support apparatus. The therapy device may receive power and air flow from the patient support apparatus.

42 Claims, 14 Drawing Sheets

(56) References Cited

U.S. PATENT DOCUMENTS 7,904,976 B2 * 3/2011 Hakamiun ..... A61G 7/05 5/53.1
8,108,957 B2 * 2/2012 Richards ..... A61H 23/04 5/734
8,584,279 B2 * 11/2013 Richards ..... A61H 23/006 601/150
8,734,369 B2 * 5/2014 Perry ..... A61H 9/0007 601/151
9,642,759 B2 * 5/2017 Stryker ..... A61G 7/1015
9,737,454 B2 * 8/2017 Hornbach ..... A61B 5/0295
9,782,323 B2 * 10/2017 Perry ..... A61H 1/008
10,507,158 B2 * 12/2019 Brzenchek ..... A61G 7/0506
10,667,984 B2 * 6/2020 Brosnan ..... A61H 9/0078
10,952,920 B2 * 3/2021 Brzenchek ..... A47C 21/042
10,987,264 B2 * 4/2021 Jiang ..... A61M 16/0009
11,529,275 B2 * 12/2022 Jiang ..... A61M 11/06
2003/0061664 A1 * 4/2003 Salvatini ..... A61G 7/0509 5/713
2003/0066135 A1 * 4/2003 Owens, Jr. ..... A47C 21/00 5/694
2008/0263771 A1 * 10/2008 Hakamiun ..... A61G 7/0506 5/706
2009/0013470 A1 * 1/2009 Richards ..... G16Z 99/00 5/613
2010/0249679 A1 * 9/2010 Perry ..... A61H 9/0078 601/148
2011/0162142 A1 * 7/2011 Hakamiun ..... A61G 7/05 5/600
2012/0016281 A1 * 1/2012 Richards ..... A61G 7/002 601/54
2014/0031730 A1 * 1/2014 Hornbach ..... G16H 20/30 601/148
2014/0207036 A1 * 7/2014 Perry ..... A61H 9/0007 601/149
2015/0135436 A1 * 5/2015 Stryker ..... A61G 7/05 5/600
2017/0172838 A1 * 6/2017 Brosnan ..... A61H 9/0078
2017/0239131 A1 * 8/2017 Brzenchek ..... A61G 7/0506
2019/0021925 A1 * 1/2019 Jiang ..... A61M 16/202
2020/0060925 A1 * 2/2020 Brzenchek ..... A61H 1/008
2020/0306129 A1 * 10/2020 Franklin ..... A61G 7/0503
2021/0212873 A1 * 7/2021 Jiang ..... A61G 7/0514

FOREIGN PATENT DOCUMENTS

EP 3714857 A1 * 9/2020 ..... A61G 7/0503
WO WO-2004091463 A2 * 10/2004 ..... A61H 9/0078

* cited by examiner

METHOD AND APPARATUS FOR UPGRADING A PATIENT SUPPORT APPARATUS TO INCLUDE AN INTEGRATED PATIENT THERAPY DEVICE

CROSS-REFERENCE TO RELATED APPLICATIONS

This application claims priority under 35 U.S.C. § 119(e) to U.S. Provisional Application No. 62/826,719, filed Mar. 29, 2019, which is expressly incorporated by reference herein.

BACKGROUND

The present disclosure relates to patient support apparatuses such as patient beds and particularly, to patient support apparatuses that have therapy devices. More particularly, the present disclosure relates to patient support apparatuses that have integrated limb compression devices.

Patient support apparatuses, such as patient beds, are used in patient rooms to support sick patients and to support patients recovering from surgery, for example. It is desirable for some patients to wear limb compression sleeves, such as foot sleeves, calf sleeves, thigh sleeves, or a combination of these sleeves. The sleeves are inflated and deflated intermittently to promote blood flow within the patient's limb or limbs thereby helping to prevent deep vein thrombosis, for example. Usually, a separate control box which houses the pneumatic components that operate to inflate and deflate the compression sleeve(s) worn by the patient is provided.

Oftentimes, the control box for the compression sleeve(s) is hung on the footboard of the patient bed. Thus, there is a risk that the control box can slip off of the footboard. Also, relatively long power cords are required to be routed from the control box at the foot end of the bed to a power outlet near the head end of the bed or elsewhere in the patient room. The foot ends of patient beds are typically oriented more toward the center of a room and not adjacent to any room wall. The power cord, therefore, may pose a tripping hazard for caregivers, patients, and visitors. The power cord also may be in the way of other carts or wheeled stands, such as those used to support IV pumps and bags, for example. When not in use, the control box must be stored separately within a healthcare facility.

There is an ongoing need to reduce the labor required for caregivers to deliver quality patient care. Further, there is an ongoing need for the cost of healthcare to be reduced. Finally, the comfort of a person in a clinical environment is directly related to their perception of the quality of their care and their recovery. A therapy system that provides patient comfort, reduced cost, and improved caregiver efficiency addresses the aforementioned needs.

SUMMARY

The present application discloses one or more of the features recited in the appended claims and/or the following features which, alone or in any combination, may comprise patentable subject matter:

According to a first aspect of the present disclosure, a therapy system comprises a patient support apparatus including a frame, a patient support surface supported on the frame, a main controller, a user interface in communication with the main controller, an air system supported on the frame, the air system including a source of pressurized air, a distribution manifold, and an air system controller in communication with the main controller, the air system controller including a processor, and a memory device. The therapy system further includes a pneumatic therapy device a port removeably pneumatically coupling the pneumatic therapy device and the distribution manifold. The therapy system further includes a storage structure for storing a portion of the pneumatic therapy device when the pneumatic therapy device is not in use. The air system controller detects a connection of the pneumatic therapy device to the distribution manifold and signals to the main controller to update the user interface to allow a user to control operation of the pneumatic therapy device from the user interface.

In some embodiments of the first aspect, the air system controller may detect a removal of the pneumatic therapy device from the distribution manifold and signals the main controller to update the user interface to reflect removal of the pneumatic therapy device.

In some embodiments of the first aspect, the pneumatic therapy device may draw power from a power supply of the patient support apparatus to operate the pneumatic therapy device and the air system, the air system simultaneously provides pressurized air to both the patient support apparatus and the pneumatic therapy device.

In some embodiments of the first aspect, the air system controller may control the flowrate of the pressurized air between the source of pressurized air, the patient support apparatus, and the pneumatic therapy device.

In some embodiments of the first aspect, the air system may further include a valve coupled to the distribution manifold and removeably coupled to the pneumatic therapy device, the valve controls the flowrate of the pressurized air between the air system and the pneumatic therapy device.

In some embodiments, the port may be independent of both the pneumatic therapy device and the manifold, the port engageable with a first pneumatic therapy device coupled to a first patient support apparatus, disengaged from the first pneumatic therapy device, and engaged with a second pneumatic therapy device coupled to a second patient support apparatus.

In some embodiments of the first aspect, the pneumatic therapy device may be a sequential compression device (SCD) assembly.

In some embodiments of the first aspect, the pneumatic therapy device may further include at least one therapy sleeve operable to engage an occupant and at least one hose having a first end and a second end spaced apart from the first end, the at least one hose is removeably coupled to the therapy sleeve at the first end of the at least one hose and to the port at the second end of the at least one hose, the at least one hose further directing a pressurized airstream from the air system to the therapy sleeve.

In some embodiments, the port may detect the removal of the at least one therapy sleeve from the port and communicates a signal of the removal of the at least on therapy sleeve to the main controller of the patient support apparatus, the main controller receives the signal and terminates operation of the therapy system.

In some embodiments of the first aspect, the port may detect the coupling of the at least one hose to the port and communicates a signal of the coupling to the main controller of the patient support apparatus, the main controller receives the signal and commences operation of the therapy system.

In some embodiments of the first aspect, the main controller may be operable to automatically commence therapy upon receiving the signal of the coupling of the at least one hose to the port.

In some embodiments of the first aspect, the patient support surface may be formed to integrally include the at least one therapy sleeve therein.

In some embodiments, the patient support surface may be formed to integrally include a pocket, the pocket formed to house the pneumatic therapy device and be accessed by a caregiver while the patient is located on the patient support apparatus.

In some embodiments of the first aspect, the patient support surface may be formed to include a head end, a foot end spaced apart from the head end, a first edge extending perpendicular to and from the head end to the foot end, a second edge extending perpendicular to and from the head end to the foot end and spaced apart from the first edge, and a body section extending longitudinally between the head end and the foot end and laterally between the first edge and the second edge. The frame includes a footboard positioned at the foot end of the patient support surface and extending between the first edge and the second edge of the patient support surface, the footboard formed to house the air system therein.

In some embodiments of the first aspect, the footboard may be formed to have a plurality of ports with at least one of the plurality of ports positioned at the second edge and at least one of the plurality of ports positioned at the first edge, the plurality of ports extending away from the patient support surface and couples to the at least one therapy sleeve.

In some embodiments of the first aspect, the footboard may include a battery to provide power to the therapy system independent of the power from patient support apparatus when the patient support apparatus is in a relined position, a seated position, or any position therebetween.

In some embodiments, the footboard may be removeable from the patient support apparatus without disrupting the therapy provided to the patient located in the patient support apparatus.

In some embodiments of the first aspect, the therapy system may be operable with a single hose coupled to a single port, a plurality of hoses coupled to a plurality of ports simultaneously, and a plurality of hoses coupled to a plurality of ports selectively.

In some embodiments of the first aspect, the plurality of hoses may include an alternative therapy device operable to cooperate with the pneumatic therapy device to treat the patient supported on the patient support apparatus.

In some embodiments of the first aspect, the footboard may be formed to include a storage space therein to house the pneumatic therapy device and an access panel moveable between an open position in which the pneumatic therapy device is accessible by the caregiver and a closed position in which the pneumatic therapy device is blocked from view and inaccessible by the caregiver.

According to a second aspect of the present disclosure, a therapy system comprises a patient support apparatus including an integrated air system and a user interface. The patient support apparatus includes an air distribution system operable to direct air from the air system to a pneumatic therapy device. The user interface is operable to provide a graphical user interface for a caregiver to control the operation of the integrated air system to vary the operation of the pneumatic therapy device. The patient support apparatus is adapted to store the pneumatic therapy device.

In some embodiments of the second aspect, the patient support apparatus wherein the patient support apparatus includes a mattress, the mattress including a port for connecting a conduit for the pneumatic therapy device to the air distribution system and including a storage section adapted to store the pneumatic therapy device within the mattress when the pneumatic therapy device is not in use.

In some embodiments of the second aspect, the mattress may include a storage space in the body of the mattress for storing the pneumatic therapy device. In some embodiments of the second aspect, the mattress may include a storage pocket formed on an edge of the mattress. In some embodiments of the second aspect, the mattress may include a storage pocket formed on an edge of the mattress.

In some embodiments of the second aspect, the patient support apparatus may include a storage drawer coupled to a frame assembly of the patient support apparatus. In some embodiments of the second aspect, the storage drawer may be movable to extend from a longitudinal end of the frame assembly. In some embodiments of the second aspect, the storage drawer may be movable to extend from a lateral side of the frame assembly. In some embodiments of the second aspect, the storage drawer may further comprise a lid.

In some embodiments of the second aspect, the patient support apparatus may include a conduit storage device that is configured as an IV pole positioned on a frame assembly of the patient support apparatus, the conduit storage device including a retention extension for securing conduits stored on the conduit storage device.

In some embodiments of the second aspect, the patient support apparatus may include a footboard with a storage space for storing pneumatic therapy devices in the storage space in the footboard. In some embodiments of the second aspect, the footboard may include a conduit retractor mechanism adapted to permit extension of a conduit from within the footboard. In some embodiments of the second aspect, a conduit supported on the conduit retractor mechanism may support a conduit that includes a first end coupleable to an outlet of the air distribution system and a second end coupleable to a sleeve of the pneumatic therapy device, while the conduit is supported on the conduit retractor mechanism. In some embodiments of the second aspect, the conduit retraction mechanism includes a ratchet assembly to allow the conduit supported thereon to be extended to a particular length. In some embodiments of the second aspect, the conduit retraction mechanism may spring-loaded and a release may be actuable to cause the conduit supported on the conduit retraction mechanism to be gathered onto the conduit retraction mechanism inside of the footboard.

In some embodiments of the second aspect, the patient support apparatus may include a conduit retractor mechanism adapted to permit extension of a conduit from within the footboard. In some embodiments of the second aspect, a conduit may be supported on the conduit retractor mechanism supports a conduit that includes a first end coupleable to an outlet of the air distribution system and a second end coupleable to a sleeve of the pneumatic therapy device, while the conduit is supported on the conduit retractor mechanism. In some embodiments of the second aspect, the conduit retraction mechanism may include a ratchet assembly to allow the conduit supported thereon to be extended to a particular length. In some embodiments of the second aspect, the conduit retraction mechanism may be spring-loaded and a release is actuable to cause the conduit supported on the conduit retraction mechanism to be gathered onto the conduit retraction mechanism inside of the footboard.

In some embodiments of the second aspect, the patient support apparatus may include a footboard that is formed to have a plurality of ports with an at least one of the plurality of ports positioned at the second edge and an at least one of the plurality of ports positioned at the first edge, the plurality of ports extending away from the patient support surface and couples to a therapy sleeve of the pneumatic therapy device.

In some embodiments of the second aspect, the patient support apparatus may include a footboard that includes a battery to provide power to the therapy system independent of the power from patient support apparatus and to the therapy system when the patient support apparatus is in a relined position, a seated position, or any position therebetween.

In some embodiments of the second aspect, the footboard is removeable from the patient support apparatus without disrupting the therapy provided to the patient located in the patient support apparatus. Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
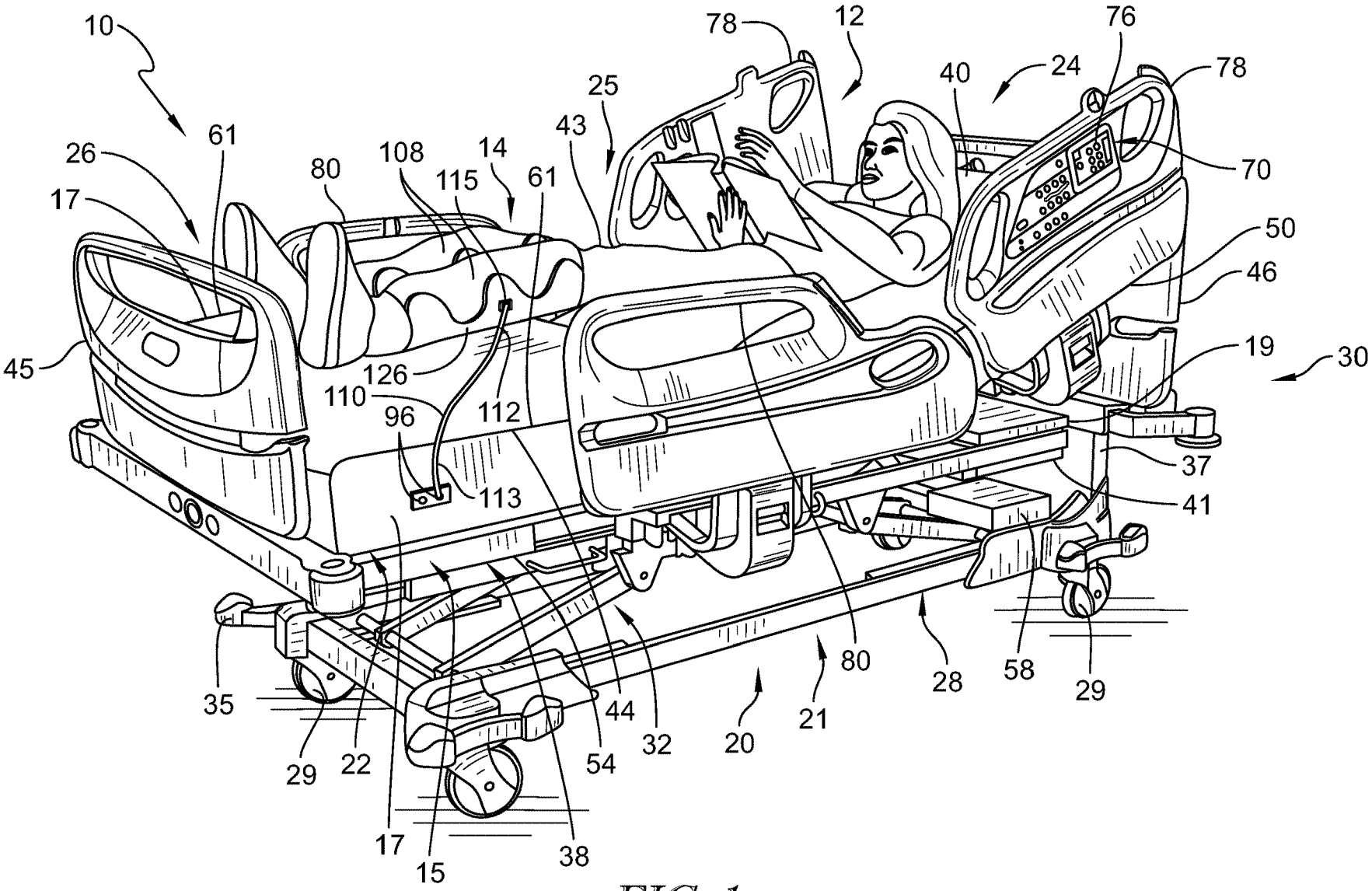
FIG. 1 is a perspective view of a patient support apparatus illustratively embodied as a hospital bed and showing a patient lying on the bed with compression sleeves positioned on the patient's lower limbs and further showing a foot section of a frame of the hospital bed having ports for coupling a conduit thereto, the conduit extending between the port and the compression sleeve to guide pressurized fluid between the patient support and the compression sleeves.
Figure 2:
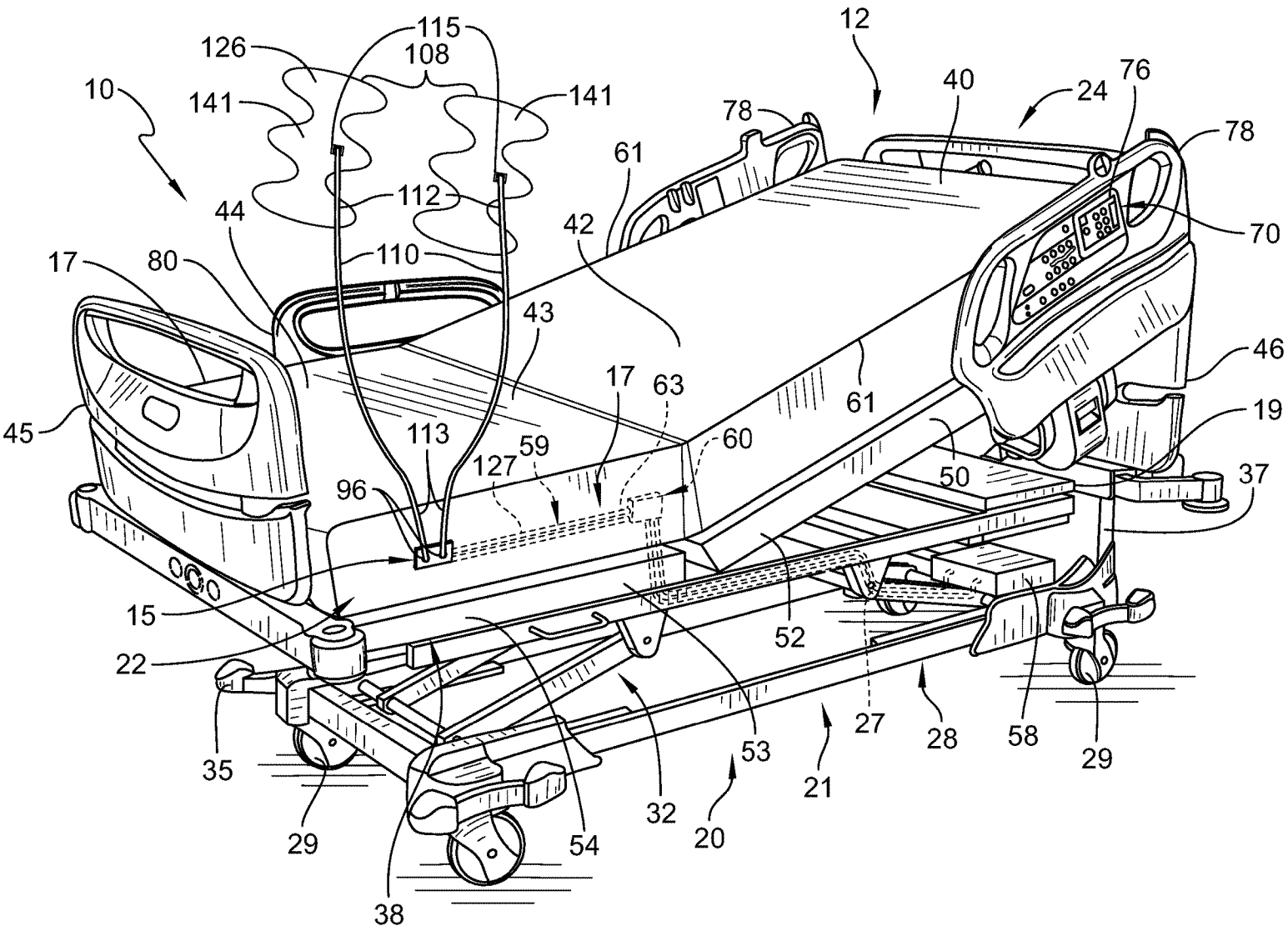
FIG. 2 is a perspective view of the patient support apparatus of FIG. 1 showing a portion of the air system of the bed coupled to the frame of the patient support apparatus and in communication with the conduit and compression sleeve(s) (together forming a pneumatic therapy device) coupled thereto.

In one embodiment of a therapy system 10, the system 10 includes a patient support apparatus 12 and a pneumatic therapy device 14 configured to couple to the patient support apparatus 12. The patient support apparatus 12, illustratively embodied as a hospital bed 12, includes a patient support structure 21 such as a frame 21 that supports a surface or mattress 22 as shown in FIGS. 1 and 2. While the patient support apparatus 12 is embodied as a hospital bed 12, this disclosure is applicable to other types of patient support apparatuses, including other types of beds, surgical tables, examination tables, stretchers, and the like. As will be described below in further detail, a main controller 18 (shown in FIG. 3) of patient support apparatus 12 is operable to control operation of pneumatic therapy device 14 using an air system 20 of patient support apparatus 12.

Pneumatic therapy device 14 is illustratively embodied as a sequential compression device assembly (SCD assembly) 14, as shown in FIGS. 1 and 2, although a variety of other pneumatic therapy devices known in the art may be used in addition to/in place of SCD assembly 14. As such, pneumatic therapy device and SCD assembly 14 are used interchangeably throughout the application. Pneumatic therapy device 14 disclosed herein utilizes an air source 58 of air system 20 coupled to patient support apparatus 12, shown diagrammatically in FIGS. 3 and 4, and is formed to include one or more compression sleeves 108 that are placed upon a patient's limbs as shown, for example, in FIG. 1. Air source, air supply, and source for pressurized air are used interchangeably throughout the application. In some embodiments, sleeves 108 are embodied as wraps that are sized to wrap about a patient's calves, thighs, and/or feet. Combination sleeves (not shown) that attach to a patient's calves and feet or that attach to a patient's calves and thighs or that attach to a patient's feet, calves and thighs are within the scope of this disclosure. Upper limb sleeves (not shown) removeably coupleable to a patient's arms and/or torso are also within the scope of this disclosure. However, sleeves 108 that attach to the patient's lower limbs are the ones that are most commonly used in sequential compression device assembly 14, particularly, for the prevention of deep vein thrombosis (DVT).

The SCD assemblies 14 disclosed herein are sometimes referred to as limb compression devices, intermittent compression devices (ICDs), DVT prevention systems, or the like. Thus, these terms and variants thereof are used interchangeably herein to cover all types of devices and systems that have compression sleeves with one or more inflatable and deflatable chambers that are controlled pneumatically by delivery and removal of air or other gas from a set of pneumatic components that are contained within patient support apparatus 12.

Referring to FIGS. 1 and 2, frame 21 of patient support apparatus 12 includes a lower frame or base 28, an upper frame assembly 30, and a lift system 32 coupling upper frame assembly 30 to base 28. Lift system 32 is operable to raise, lower, and tilt upper frame assembly 30 relative to base 28. Patient support apparatus 12 has a head end 24 and a foot end 26 spaced apart from each other with a body section 25 extending therebetween. Patient support apparatus 12 further includes a footboard 45 coupled to patient support apparatus 12 at foot end 26, a headboard 46 coupled to patient support apparatus 12 at head end 24, and a pair of sides 17 spaced apart from each other and extending laterally from foot end 26 to head end 24 of patient support apparatus 12. Headboard 46 is coupled to an upstanding portion 37 of base 28. Footboard 45 is removeably coupled to an extendable and retractable portion 47 of a foot section 54 of a patient support deck 38 of upper frame assembly 30. In other embodiments, footboard 45 is coupled to a foot end 39 of upper frame assembly 30. Illustratively, base 28 includes a plurality of wheels or casters 29 that roll along a floor as patient support apparatus 12 is moved from one location to another. A set of foot pedals 35 are coupled to base 28 and are used to brake and release casters 29 as is known in the art.

Illustrative patient support apparatus 12 has four siderail assemblies coupled to upper frame assembly 30 as shown in FIG. 1. The four siderail assemblies include a pair of head siderail assemblies 78 (sometimes referred to as head rails) and a pair of foot siderail assemblies 80 (sometimes referred to as foot rails). Each of the siderail assemblies 78, 80 is movable between a raised position, as shown in FIG. 1, and a lowered position (not shown but well-known to those skilled in the art). Siderail assemblies 78, 80 are sometimes referred to herein as siderails 78, 80.

Upper frame assembly 30 includes a patient support deck 38 that supports mattress 22. Patient support deck 38 is situated over an upper frame 19 of upper frame assembly 30. Mattress 22 includes a head section 40, a seat section 42, a thigh section 43, and a foot section 44 in the illustrative example as shown in FIGS. 1 and 2. Patient support deck 38 is formed to include a head section 50, a seat section 52, a thigh section 53, and a foot section 54 such that respective mattress sections 40, 42, 43, 44 are positioned thereon. Mattress sections 40, 42, 43, 44 are each movable relative to upper frame 19. For example, head section 40 pivotably raises and lowers relative to seat section 42 whereas foot section 54 pivotably raises and lowers relative to thigh section 43. Additionally, thigh section 53 articulates relative to seat section 42.

Mattress 22 further includes a pair of edges 61 wherein each of the pair of edges 61 is spaced apart from each other with respective section 40, 42, 43, 44 extending therebetween. In the illustrative embodiment, thigh section 43 and/or foot section 44 is configured to support SCD assembly 14 when independent of the patient as well as when coupled thereto. As will be discussed below, in some embodiments, thigh section 43 and/or foot section 44 may be formed to integrally include SCD assembly 14 and/or be configured to store SCD assembly 14 therein when not in use, when patient is ambulatory, and/or to avoid SCD assembly 14 from contacting a floor of a hospital/care center.

Figure 3:
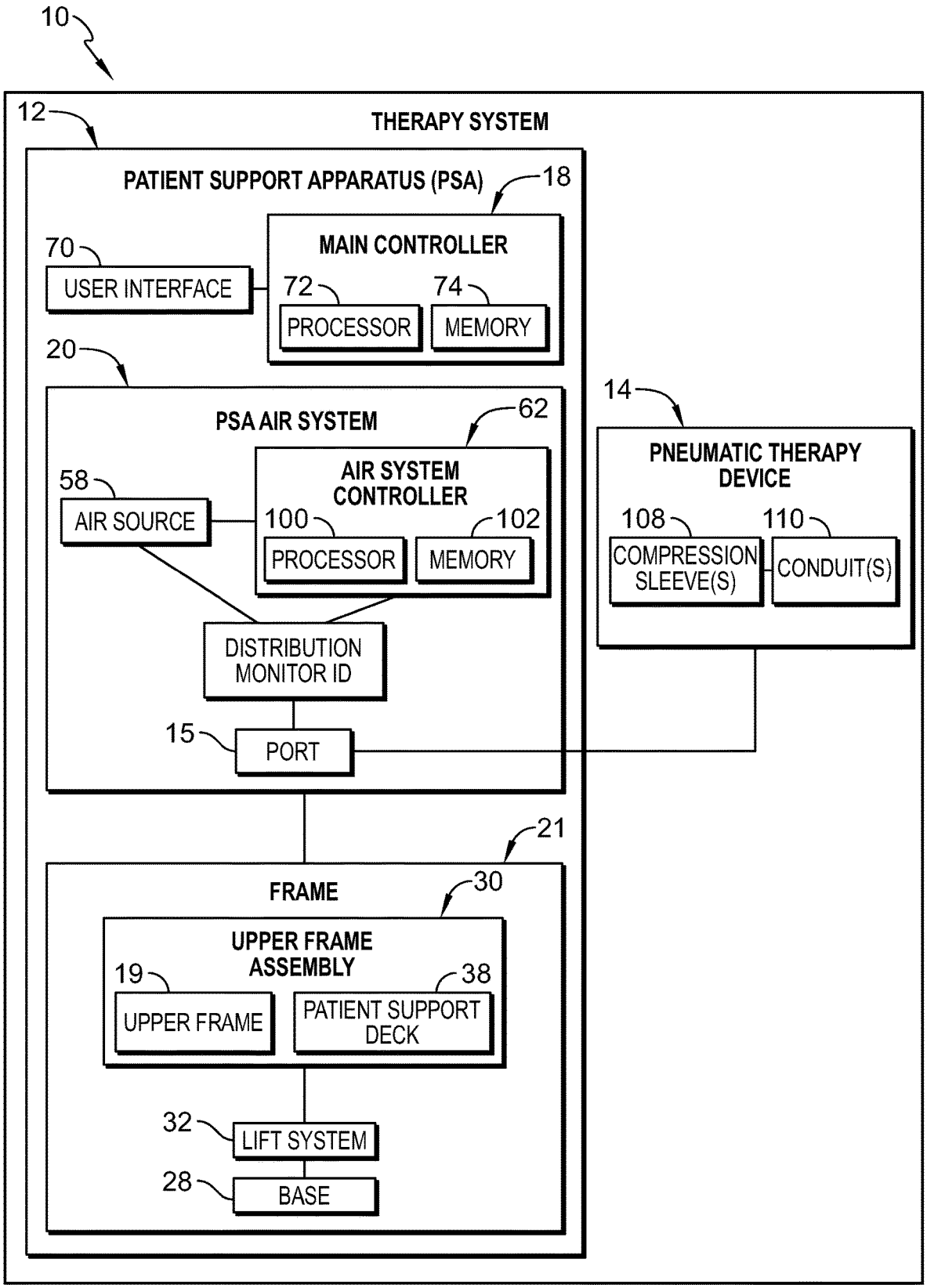
FIG. 3 is a block diagram showing the pneumatic components of the bed of FIG. 1 and showing the pneumatic therapy device of FIG. 2 in communication with the air system of the patient support apparatus.
Figure 4:
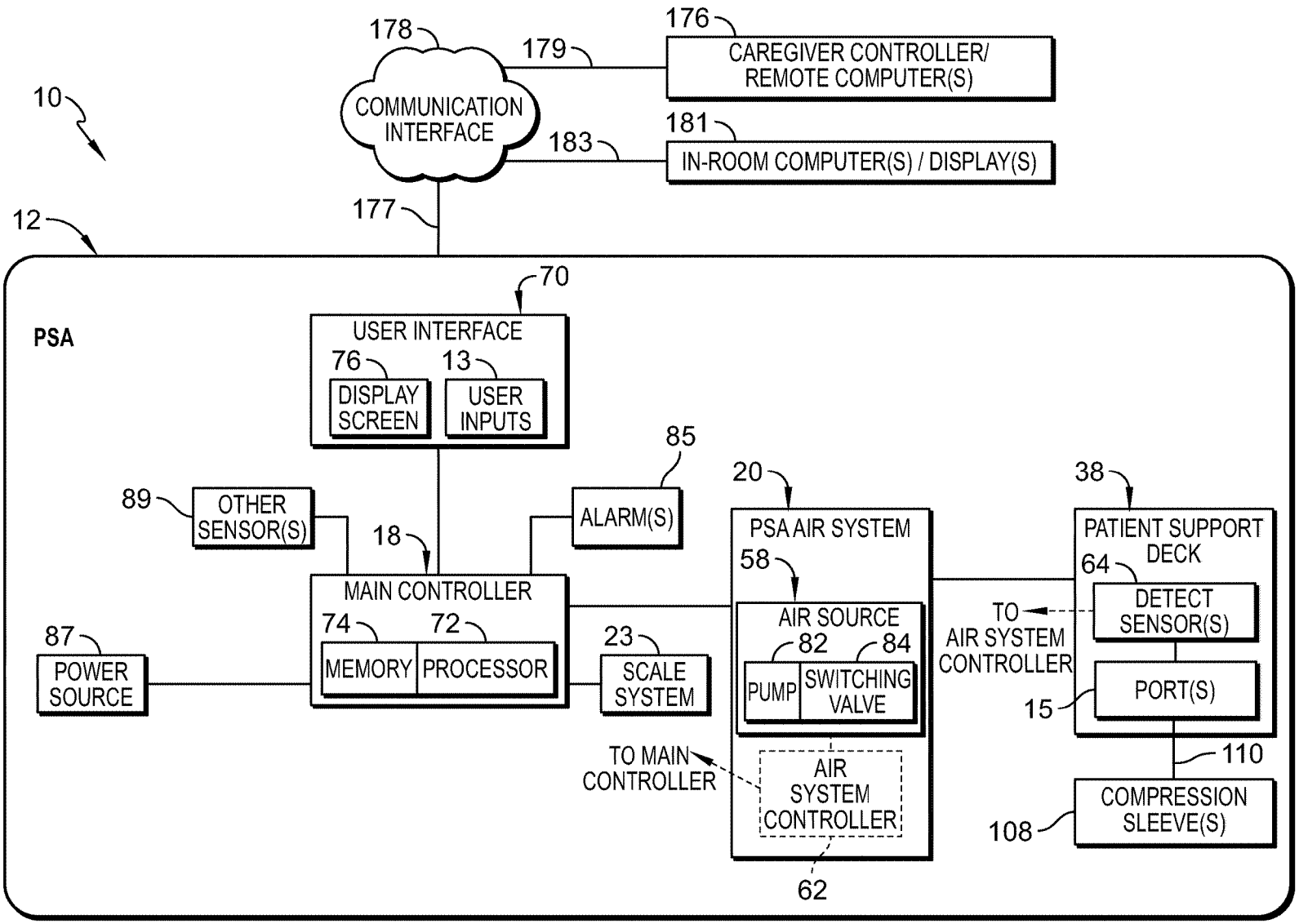
FIG. 4 is a block diagram showing the electric and communication components of the bed of FIG. 1 and showing the compression sleeve(s) and conduit in communication with an air system controller configured to communicate with a main controller of the patient support apparatus.

Referring to FIGS. 3 and 4, when in use, SCD assembly 14 is configured to communicate with main controller 18 electrically coupled to air system 20 and a user interface 70. Main controller 18 may be formed to include various circuit boards, electronics modules, and the like that are electrically and communicatively interconnected. Main controller 18 includes one or more microprocessors or microcontrollers 72 that execute software to perform the various bed control functions and algorithms along with compression device control functions and algorithms as described herein. Thus, main controller 18 also includes memory 74 for storing software, variables, calculated values, and the like as is known in the art.

As shown diagrammatically in FIG. 4, main controller 18 includes a processor 72 and a memory device 74 that stores instructions and/or algorithms used by processor 72. Processor 72 executes the instructions and algorithms stored in memory 74 to perform the various bed control functions and algorithms along with SCD assembly 14 functions and algorithms described herein.

Main controller 18 is further configured to be in communication with user interface 70. User interface 70 is configured to receive user inputs by the caregiver and/or patient, to communicate such input signals to main controller 18 of patient support apparatus 12 to control the operation of air system 20 and SCD assembly 14 of patient support apparatus 12, and to control the operation of other functions of patient support apparatus 12. User interface 70 is further configured to provide access to air system controller 62 to control operation of SCD assembly 14 from user interface 70. User interface 70 may be formed as a graphical user input (GUI) or display screen 76 coupled to a respective siderail 78 as shown in FIGS. 1 and 2. Display screen 76 is coupled to main controller 18 as shown diagrammatically in FIG. 4. In some embodiments, two GUI's 76 are provided and are coupled to head siderails 78. Alternatively or additionally, one or more GUI's are coupled to foot siderails 80 and/or to one or both of the headboard 46 and footboard 45. Alternatively or additionally, GUI 76 is provided on a hand-held device such as a tablet, phone, pod or pendant that communicates via a wired or wireless connection with main controller 18.

As such, main controller 18 is configured to act on information provided by user interface 70 to control air system 20 based on inputs from a user. For example, user interface 70 includes a user input device (not shown) that is indicative of when a user wishes to actuate therapy of SCD assembly 14. The user input device corresponds to sequential compression of SCD assembly 14. Similarly, the user input device provides a signal to main controller 18 that therapy provided by SCD assembly 14 is to be halted when the user input device provides a signal indicative of a user's desire to stop sequential compression of SCD assembly 14. As such, user input devices may signal/indicate that the sequential compression of the respective SCD assembly 14 is to be actuated and/or ceased.

In some embodiments, main controller 18 of patient support apparatus 12 communicates with a caregiver controller/remote computer device 176 via a communication infrastructure 178 such as a wired network of a healthcare facility in which patient support apparatus 12 is located and/or via communications links 177, 179 as shown diagrammatically in FIG. 4. Infrastructure 178 may be operated according to, for example, wired and/or a wireless links. Caregiver controller 176 is sometimes simply referred to as a "computer" or a "server" herein. In some embodiments, main controller 18 of patient support apparatus 12 communicates with one or more in-room computers or displays 181 via communication infrastructure 178 and communications link 183. In some embodiments, display 181 is an in-room station or a nurse call system.

Remote computer 176 may be part of a bed data system, for example. Alternatively or additionally, it is within the scope of this disclosure for circuitry (not shown) of patient support apparatus 12 to communicate with other computers 176 and/or servers such as those included as part of an electronic medical records (EMR) system, a nurse call system, a physician ordering system, an admission/discharge/transfer (ADT) system, or some other system used in a healthcare facility in other embodiments, although this need not be the case.

In the illustrative embodiment, patient support apparatus 12 has a communication interface which provides bidirectional communication via link 177 with infrastructure 178 which, in turn, communicates bidirectionally with computers 176, 181 via links 179, 183 respectively as shown in FIG. 4. Link 177 is a wired communication link in some embodiments and is a wireless communications link in other embodiments. Furthermore, communications links 179, 183 each comprises one or more wired links and/or wireless links as well, according to this disclosure. Remote computer 176 may be part of a bed data system, for example. Alternatively or additionally, it is within the scope of this disclosure for the circuitry of patient support apparatus 12 to communicate with other computers 176 and/or servers such as those included as part of the EMR system, a nurse call system, a physician ordering system, an admission/discharge/transfer (ADT) system, or some other system used in a healthcare facility in other embodiments, although this need not be the case.

Still referring to FIG. 4, main controller 18 is in communication with a scale system 23 coupled to frame 21 that may be operable to determine a weight of the patient positioned on patient support apparatus 12. Main controller 18 may vary an operating parameter of therapy system 10 depending upon the weight of the patient sensed by scale system 23. Scale system 23, using load cells, is used to detect the weight of a patient positioned on the patient support apparatus 12, movement of the patient on patient support apparatus 12, and/or the exit of the patient from patient support apparatus 12. Other sensors may be used in conjunction with or as an alternative to the load cells of the scale system 23, including, for example, force sensitive resistors (FSRs) that are placed beneath the mattress 22 of the patient support apparatus 12 on the patient support deck 38.

As shown in FIG. 4, patient support apparatus 12 has one or more alarms 85. Such alarms 85 may be one or more audible alarms and/or visual alarms coupled to the circuitry. Audible alarms 85 include, for example, a speaker, piezoelectric buzzer, or the like. The circuitry controls audible alarms 85 to sound in response to various alarm conditions detected. Visual alarms 85 include, for example, one or more alert lights that are provided on frame 21 of patient support apparatus 12 and that are activated in different ways to indicate the conditions of patient support apparatus 12. For example, when no alerts or alarms exist, the lights are activated to shine green. When an alert or alarm occurs, including a bed exit alarm, lights are activated to shine red or amber and, in some embodiments, to blink. Other visuals alarms that may be used in addition to, or instead of, such alert lights include changing a background color of graphical display screen 76 and/or displaying an iconic or textual alarm message on display screen 76 and may even include IV pole mounted or wall mounted devices such as lights and/or graphical display screens.

It should be understood that FIG. 4 is diagrammatic in nature and that various portions of patient support apparatus 12 and the circuitry thereof is not depicted. However, a power source block 87 is intended to represent an onboard battery of patient support apparatus 12 and an AC power cord of patient support apparatus 12 as well as the associated power handling circuitry. Also, the block representing other sensors 89 represents all other sensors of patient support apparatus 12 such as one or more sensors 64 used to sense whether a caster braking system of patient support apparatus 12 is in a braked or released position and/or sensors 64 used to detect whether each of the siderail assemblies 78, 80 is raised or lowered, or other sensors as known in the art.

As discussed above, main controller 18 includes a processor 72 and a memory device 74 that stores instructions used by processor 72 as shown in FIGS. 3 and 4. Processor 72 may further consider information gathered from sensors 64, air system controller 62, and SCD assembly 14 to determine when to actuate, adjust, or cease the sequential compression. Illustratively, such sensors 64 are embodied as pressure sensors 64 although it may be embodied as other sensors known in the art used either alone or in combination with pressure sensors 64.

Further, memory device 74 may be pre-programmed to alert the caregiver upon exceeding a predetermined threshold so to avoid patient discomfort, pressure necrosis, and/or loss of capillary integrity leading to edema and increased compartmental pressures. To explain, memory device 74 may be configured to alert the caregiver of a pressure of SCD assembly 14 which exceeds a predetermined threshold pre-programmed therein.

Such a predetermined threshold of pressure may be based on the patient's vitals, medical history, desired outcome of pneumatic therapy (i.e.: sequential compression therapy via SCD assembly 14), as well as other data measurements by sensors 64. Therefore, it is desirable to identify the sequential compression threshold of each patient and avoid reaching such a threshold to avoid patient discomfort, pressure necrosis, and other associated complications.

Figure 6:
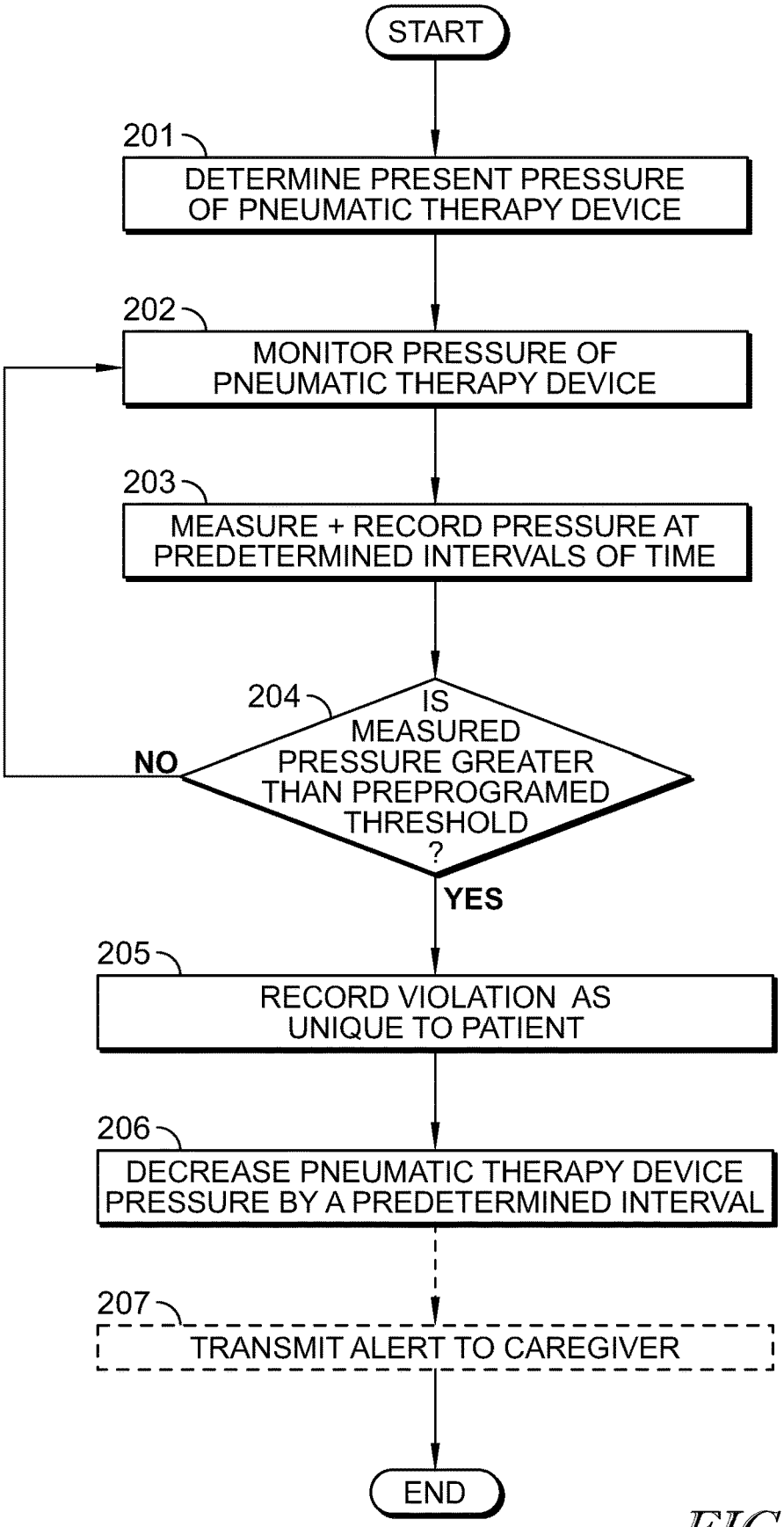
FIG. 6 is a flowchart showing an algorithm preprogrammed in the main controller and configuring the main controller to measure the pressure of the pneumatic therapy device, compare the measured pressure to a preprogrammed threshold, and determine/communicate any necessary pressure adjustment to the air source.

This may be accomplished via the method shown in FIG. 6. This method includes determining/preprograming main controller 18 with the ideal pressure/therapy to be applied upon the patient via pneumatic therapy device 14. Step 201 includes determining the present pressure applied upon the patient by pneumatic therapy device 14 using sensors 64. Step 202 includes monitoring the pressure applied upon the patient by pneumatic therapy device 14 throughout pneumatic therapy. Main controller 18 is configured to identify and record the pressure of pneumatic therapy device 14 by measuring and recording the pressure of SCD assembly 14 at pre-determined time intervals (i.e.: every 30 minutes, every 1 hour, etc.), at step 203. The measured pressure of pneumatic therapy device 14 is then compared to the pre-programmed threshold to determine a threshold violation via the cooperation of sensors 64 and air system 20, at step 204. If no violation has occurred, sensors 64 and air system 20 return to step 202. If a violation has occurred, the violation is recorded as unique to the patient located on patient support apparatus 12, at step 205. In approaching the pre-programmed threshold of pressure, the patient is at an increased risk of pressure necrosis, edema, acute compartment syndrome, and/or peroneal nerve palsy. Therefore, the avoidance of maintaining increased pressure on a patient for extended periods of time is desirable. As such, when the pre-programmed threshold is exceeded, main controller 18 is configured to communicate with air system controller 62 to automatically adjust the pressure of pneumatic therapy device 14, at step 206. In some embodiments, step 207 includes alerting the caregiver of the violation. Optionally, only one of steps 206 or 207 may be completed. Illustratively, both pneumatic therapy device 14 pressure is adjusted and the caregiver is alerted such that steps 206 and 207 are completed by main controller 18. Main controller 18 is further configured to measure, record, and adjust the pressure of pneumatic therapy device 14 automatically at periodic intervals, as discussed above. These intervals may be programmed to run at intervals pre-programmed into main controller 18, randomly run by main controller 18, or some combination thereof.

Figure 5:
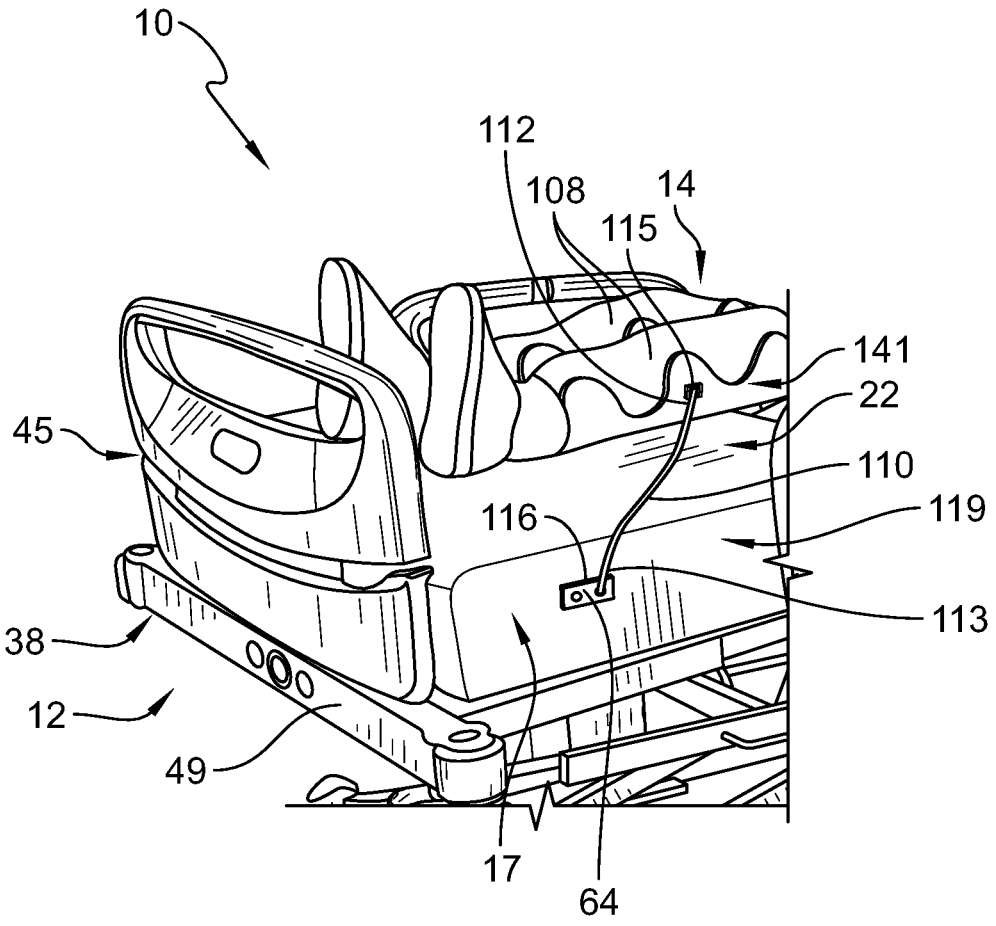
FIG. 5 is a perspective view of a foot end of the bed of FIG. 1 showing the coupling of the pneumatic therapy device to the support surface of the bed.

As mentioned previously, the operation of SCD assembly 14 is controlled by main controller 18 in communication with air system 20. Referring now to FIGS. 1, 2, and 5, air source 58 is illustratively coupled to frame 21 underneath a head end 41 of upper frame assembly 30 and is configured to supply and direct a pressured air stream to SCD assembly 14. Air system 20 includes a source of pressurized air 58, a distribution manifold 60, and an air system controller 62. Source of pressurized air 58 is configured to generate and communicate a pressurized air stream to SCD assembly 14 through distribution manifold 60 coupled to frame 21 and a plurality of tubes 27 extending therebetween. A plurality of air hoses 59 are coupled to distribution manifold 60 and extend between distribution manifold and edge 31 of deck 38 terminating in a port 15. The plurality of tubes 27, distribution manifold 60, and plurality of air hoses 59 cooperate to guide the pressurized air stream from source of pressurized air 58 to SCD assembly 14. Distribution manifold 60 is formed to include a plurality of valves 63 and a plurality of pressure sensors 64 and is configured to adjust the pressure of the air from the source of air 58 before it enters pneumatic therapy device 14. Air system controller 62 is in communication with main controller 18, source of pressurized air 58, and distribution manifold 60 and is operable to detect connection of SCD assembly 14 to port 15, communicate detection of connection to main controller 18, and initiate operation of therapy system 10 in response to the communication. The detection of SCD assembly 14 may be accomplished by an at least one pressure/attachment sensor 64 configured to identify attachment of SCD assembly 14 to port 15 by monitoring changes in pressure readings that occur when connected.

Source of pressurized air 58 is illustratively coupled to base 28 of bed 12 at head end 24 of bed 12, in communication with main controller 18 and air system controller 62, and coupled to distribution manifold 60. Illustratively, source of pressurized air 58 is embodied as a compressor 58 of patient support apparatus 12 such that air system 20 shares compressor 58 with patient support apparatus 12 as well as with other therapy systems coupled thereto. In utilizing a single source of pressurized air 58 for functions of bed 12 and air system 20, therapy system 10 reduces the clutter of a second, distinct source of pressurized air commonly associated with SCD assemblies 14 and configured to operate solely with SCD assembly 14 and/or other modular therapies. As such, in some contemplated embodiments, wherein mattress 22 is an air mattress that contains one or more air bladders or layers (not shown), air system 20 is configured to control inflation and deflation of the various air bladders or cells and/or layers of air mattress 22 as well as SCD assembly 14. Source of pressurized air 58 may be embodied as a fan, a blower, or any other source configured to provide pressurized air known in the art.

As shown in FIG. 4, source of pressurized air 58 includes a pump 82 and a switching valve 84. Pump 82 is coupled to switching valve 84 and configured to draw ambient atmospheric air into air source 58 and exhaust air into the atmosphere. Switching valve 84 is exposed to the atmosphere and configured to either provide for or block the air into and out of air source 58. Pump 82 includes an inlet (not shown) and an outlet (not shown) coupled to switching valve 84 and is configured to cooperate with switching valve 84 to create a flow path for the air. Switching valve 84 includes a plurality of outlets (not shown) coupled to the inlet of pump 82 and a second inlet (not shown) coupled to the outlet of pump 82. At least one outlet of switching valve 84 is open to the atmosphere to provide the flow path for drawing air into air source 58 or exhausting air to the atmosphere depending on the position of switching valve 84.

Distribution manifold 60 is positioned within mattress 22 and configured to direct the pressurized air stream away from source of pressurized air 58 and terminate at a second end 95 at a port 15 formed in mattress 22, as shown in FIGS. 1 and 2. Distribution manifold 60 includes a plurality of valves (not shown) to control air flow between pressurized air source 58 and SCD device assembly 14. Illustratively the valves are embodied as solenoid valves. In addition, manifold 60 is operable to close the plurality of valves to maintain the pressure in SCD assembly 14. Manifold 60 may also selectively control venting of the SCD assembly 14 to an exhaust (not shown). Illustratively, distribution manifold 60 guides pressurized air stream towards port 15 formed in each of edge 31 of mattress 22. Illustratively, a port 15 is formed in the foot section 44 of each edge 31 of mattress 22. Port 15 is configured to couple to SCD assembly 14 and, thereby, guide pressurized air into SCD assembly 14 during therapy. Illustratively, port 15 is formed to include a plurality of apertures/valves 16. Each aperture/valve 16 is configured to couple to a single SCD assembly/therapy module 14 such that each port 15 is configured to couple to multiple SCD assemblies 14/therapy modules 14. Illustratively, each valve 16 is configured to couple to two SCD assemblies 14 such that each valve 16, is configured to operate independently of the other. In some embodiments, additional ports 15 are formed in mattress 22 and configured to couple to additional SCD assemblies and/or other therapy devices 14. Distribution manifold 60 is in communication with air system controller 62 and configured to operate in response to commands from air system controller 62 and/or main controller 18.

As such, upon receiving an input from user interface 70, main controller 18 communicates the appropriate signal(s) to air system controller 62 to control air system 20. Therefore, when a function is requested by main controller 18, air system controller 62 is configured to energize the appropriate valve of distribution manifold 60 and set an appropriate pulse width modulation for source of pressurized air 58. Illustratively, ambient, environmental air enters air system 20 through distribution manifold 60 and to SCD assembly 14. Illustratively, pressurized air is guided into conduit 110 of SCD assembly 14 through port 15. Conduit 110 guides the pressurized air into therapy sleeve 108 via a pneumatic connector 115 formed in an outer surface 141 of sleeve 108. Illustratively, each sleeve 108 is formed to include a pressure tap (not shown) in communication with air system 20. The pressure taps are routed to distribution manifold 60 and coupled to a plurality of pressure sensors 64 through sense lines for feedback of pressure levels within SCD assembly 14. For example, if pressure in sleeve(s) 108 exceeds a threshold pre-programmed in main controller 18, pressure sensors 64 sense the sleeve(s)' 108 pressure, provide feedback to main controller 18, and the main controller 18 communicates with air system controller 62 to adjust the pressure of sleeve(s) 108 accordingly. The aforementioned system is closed-loop and feedback dependent.

Illustratively, sensors of sensor block 89, such as, for example, Hall-effect sensors, RFID sensors, near field communication (NFC) sensors, pressure sensors, or the like, are configured to sense tokens (e.g., magnets, RFID tags, NFC tags, etc.). Illustratively, the type/style of sleeve 108 is sensed by sensors 64 and communicated to main controller 18 which, in turn, communicates the sleeve 108 type information to the circuitry for ultimate display on GUI 76 in connection with the compression device control screens. Illustratively, pressure sensors 64 are configured to identify the presence and absence of conduit 110 and, in response, automatically begin, halt, or adjust therapy, respectively, which is discussed in further detail below.

To control pressure, air system controller 62 is configured to regulate the speed of source of pressurized air 58 in correlation to pressure. For example, if a pre-programmed threshold requires a particular discharge from source of pressurized air 58 for function of SCD assembly 14, then main controller 18 is configured to communicate to air system controller 62 so that the appropriate pulse width modulation settings are fixed so to establish the correct pressure and flow output from source of pressurized air 58.

Air system controller 62 is in electrical communication with aforementioned plurality of pressure sensors 64 and is configured to control the operation of air system 20, including the operation of distribution manifold 60 and air source 58, to control the pressure within SCD assembly 14. As such, main controller 18 is configured to monitor the pressure in SCD assembly 14 and determine a violation of the pre-programmed pressure threshold in SCD assembly 14 based on signals received from pressure sensors 64. Main controller 18 receives a plurality of signals indicative of the pressure of SCD assembly 14 from respective pressure sensors 64, as discussed above. Main controller 18 is further configured to interpret signals received from pressure sensors 64 and compare them to the predetermined threshold. Upon exceeding this threshold, main controller 18 is configured to convey a signal to air system controller 62 instructing a decrease in pressure and flow output from source of pressurized air 58. Main controller 18 is further configured to produce an alarm 85 to notify the caregiver of the event violating the threshold and/or other information associated with SCD assembly 14 and/or the patient. Such alarms 85 may be audio, visual, tactile, and/or any other method of notification known in the art. In some embodiments, air system controller 62 may be in communication with sensors 64 and configured to interpret the signals from pressure sensors 64 to main controller 18, determine if a pre-programmed threshold has been violated, communicate such a violation to main controller 18 and decrease the flow output of source of pressurized air 58. In such an embodiment, main controller 18 is illustratively programmed to produce and convey and alarm to the caregiver of the violation of the pre-programmed threshold upon evaluation of the signals received from air system controller 62.

Air system controller 62 includes a processor 100 and a memory device 102 which stores instructions used by processor 100 as shown in FIG. 3. In some embodiments, processor 100 may consider information gathered from pressure sensors 64 and/or SCD assembly 14 to determine when to provide pressure to SCD assembly 14 such that sequential compression may occur. As discussed above, in some embodiments, main controller 18 is in communication with air system controller 62 such that upon reaching a predetermined pressure threshold, a signal is sent first from pressure sensors 64 to main controller 18 and then communicated to air system controller 62. In some embodiments, air system controller 62 itself is pre-programmed to identify pressure exceeding a preprogramed threshold and is further configured to convey such information to main controller 18. Illustratively, air system controller 62 and main controller 18 are configured to cooperate to alert the caregiver when the pressure of SCD assembly 14 exceeds the pre-programmed threshold.

As discussed above, SCD assembly 14 is configured to provide sequential compression therapy to a patient positioned on patient support apparatus 12 as shown in FIG. 1. SCD assembly 14 is removeably coupled to distribution manifold 60 and is configured to contain the pressurized air stream such that the pressure thereof may be applied to the patient via SCD assembly 14. SCD assembly 14 includes at least one compression sleeve 108 and at least one conduit 110 having a first end 112 removeably coupled to compression sleeve 108 and a second end 113 removeably coupled to port 15. In the illustrative embodiment, sleeve 108 is formed to fit a patient's lower leg. In other embodiments, the sleeve 108 may be formed to fit a patient's foot, calf, thigh, or some combination thereof. Conduit 110 is configured to extend between sleeve 108 and distribution manifold 60 such that the pressurized air stream formed by source of pressurized air 58 is directed from source 58 through distribution manifold 60 and further through conduit 110 until reaching sleeve 108. As such, when sleeve 108 is positioned on a lower extremity of the patient, SCD assembly 14 is configured to provide each lower extremity of the patient with therapy independent of the other. Further, main controller 18 may be configured to selectively inflate a first compression sleeve 108 independent of a second compression sleeve 108 such that the second compression sleeve 108 remains uninflated throughout the duration of therapy. Illustratively, each sleeve 108 has a respective conduit 110 coupled thereto and is independent of the other. In some embodiments, a single conduit 110 is shared between multiple sleeves 108.

As such, sleeves 108 are configured to adjust the amount of compression applied to the patient in response to instructions from main controller 18 and/or air system controller 62. Specifically, sleeves 108 are configured to respond to user inputs including, for example, the target pressure to which each sleeve 108 is to be inflated by air system 20 and/or the desired zone(s) (i.e.: foot zone, calf zone, thigh zone, or some combination thereof) of each sleeve 108 to be inflated by air system 20 if sleeve 108 has multiple zones. The selectable therapy settings further include, for example, the frequency of compression, the duty cycle of the compression cycles, the number of cycles, the time period over which the compression therapy is to take place, or some combination thereof. In some embodiments, the selectable therapy settings include selection of pressure versus time curves (e.g., step up and/or step down curves, ramp up and/or ramp down curves, saw tooth curves, and the like) as well as the parameters for the various types of curves (e.g., pressure setting at each step, duration of each step, duration of ramp up, duration of ramp down, and the like).

Looking to FIGS. 1 and 2, and as discussed above, compression sleeves 108 are formed to include pneumatic connector 115. Connector 115 is coupled to an outer surface 141 of sleeve 108 and configured to couple conduit 110 thereto. Illustratively, connector 115 extends away from sleeve 108 a distance to reduce the likelihood of long-term contact between conduit 110 and the patient which otherwise results in patient discomfort. In such embodiments, connector 115 may be formed as a pigtail pneumatic connector 115. A pigtail pneumatic connector 115 is formed to couple sleeve 108 and conduit 110 and is extends the length of connector 115 such that conduits 110 are spaced apart from the patient at a greater distance than a non-pigtail pneumatic connector 115. To further avoid patient discomfort resulting from prolonged patient contact with conduits 110, in some embodiments, pneumatic connector 115 includes an outer shell (not shown) formed from a pliable material. In other embodiments, pneumatic connector 115 includes an inner shell (not shown) formed from a rigid material and an outer cover (not shown) encompassing the inner shell and formed from a pliable material.

As shown in FIGS. 1 and 2, conduit(s) 110 are configured to removeably couple to a port 15 and may be embodied as tubes and/or hoses. As such, conduit(s) 110 are configured to extend between port 15 and sleeve(s) 108 and are formed to receive pressurized air from air system 20. Illustratively, at least one port 15 is formed in each lateral side 17 of patient support apparatus 12. Further, multiple ports 15 may extend outwardly from upper frame assembly 30. In coupling conduit 110 and distribution manifold 60, port 15 configures conduit 110 to guide stream of pressurized air towards sleeve 108. Illustratively, each of a pair of compression sleeves 108 is configured to couple to a respective first end 112 of each of a pair of conduits 110 such that each compression sleeve 108 is configured to provide sequential compression to a lower extremity of the patient. In some embodiments, a multi-port connector (not shown) is provided at second end 113 of conduits 110 to permit simultaneous attachment of multiple conduits 110 to associated coupler(s) 116 positioned at opposite lateral sides 17 of patient support apparatus 12.

Figure 9:
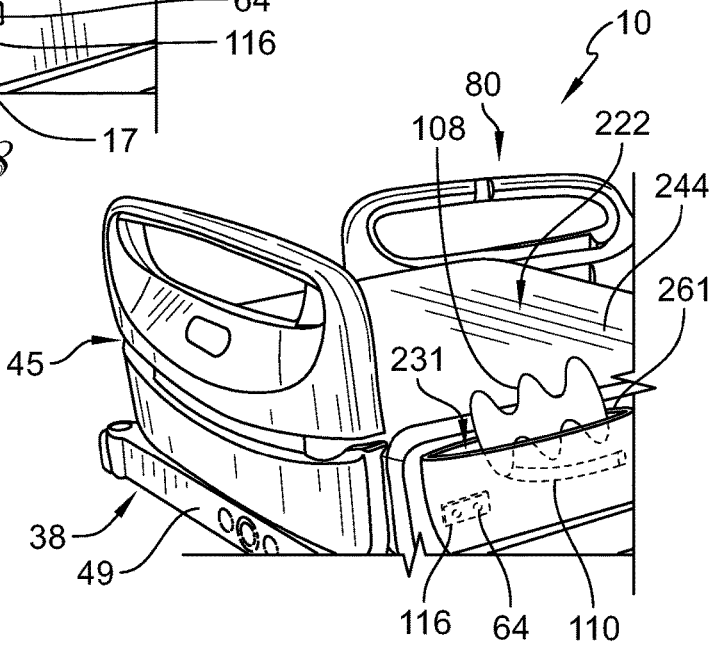
FIG. 9 is a perspective view of an alternative embodiment of the foot section of the support surface shown in FIG. 1 showing a storage pocket integrally formed within a lateral side of the foot section of the support surface and configured to store the pneumatic therapy device.

As shown in FIG. 9, port 15 is formed in mattress 22 and is accessible by a caregiver when the patient is positioned on the mattress 22 and configured to couple to multiple SCD assemblies 14. Illustratively, a plurality of SCD assemblies 14 may be removeably coupled to port 15 formed in either edge 31 of deck 38. Additionally, and as discussed above, upon identifying the presence of conduit 110 removeably coupled to port 15, main controller 18 is configured to initiate sequential compression therapy upon identifying the removal of conduit 110 from port 15.

A caregiver may also initiate/terminate therapy by using user interface 70 and inputting the desired action. As such, a particular zone/combination of zone and sleeves 108 may be selected by the caregiver using user interface 70 via user inputs or buttons 13. For example, buttons 13 for selection by a user of left and/or right foot sleeves, left and/or right calf sleeves, left and/or right thigh sleeves, or left and/or right combination sleeves such as those described above appear on display screen 76, in some embodiments. It should be appreciated that the compression sleeve 108 on a patient's left leg may be of a different type than that on the patient's right leg. Alternatively or additionally, main controller 18 is operable to determine which type of sleeve 108 is connected to each port 15 based on the time it takes to inflate the particular sleeve 108 to a target pressure as measured by pressure sensors 64. After main controller 18 makes the sleeve type determination for the one or more sleeves 108 coupled to coupler(s) 116, such information is displayed on GUI 76. This may be accomplished via the algorithm shown in FIG. 7.

Figure 7:
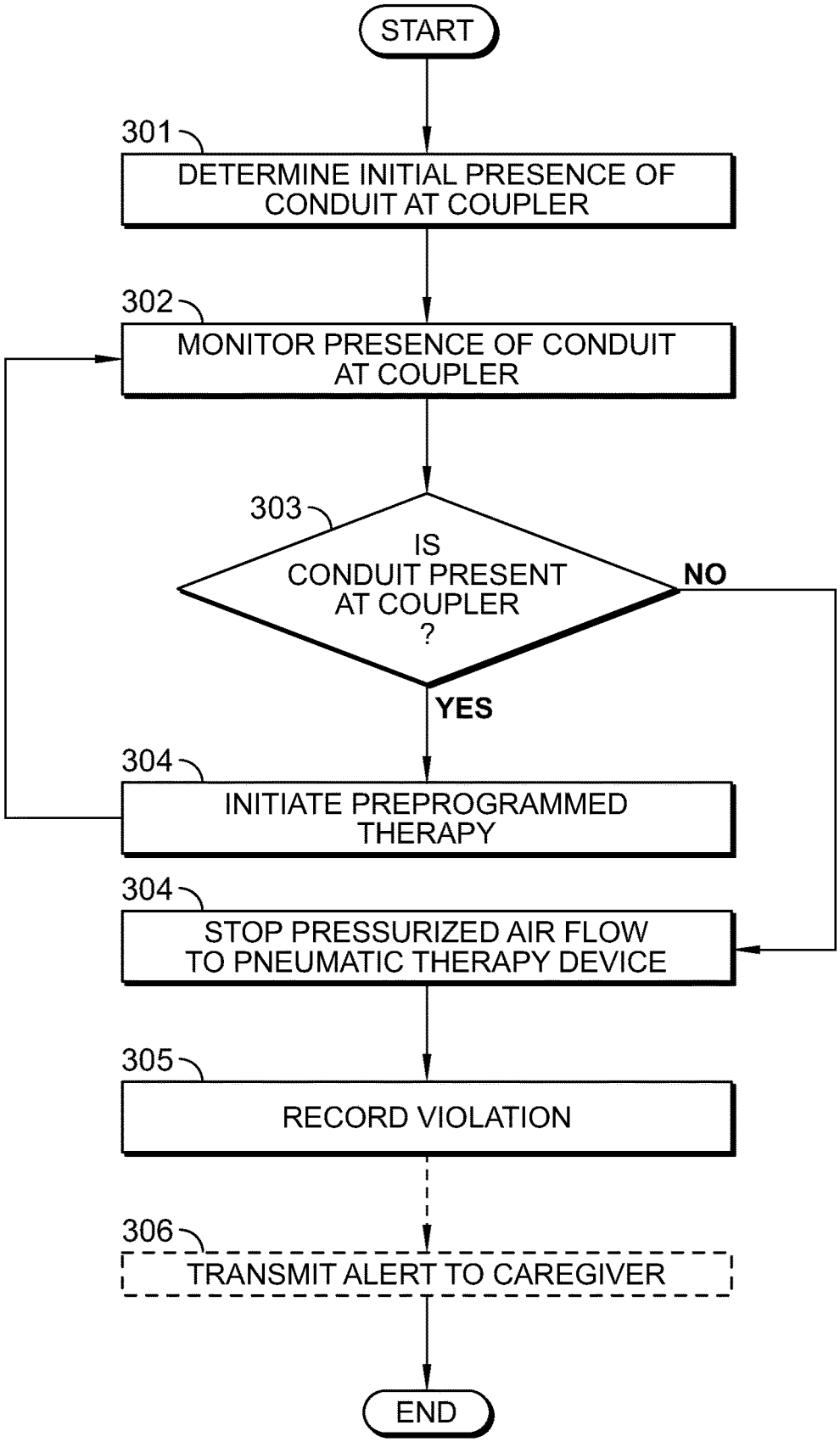
FIG. 7 is a flowchart showing an algorithm preprogrammed in the main controller and configuring the main controller to determine the presence of the conduit at the port formed in the bed of FIG. 1 or other embodiments and initiate/continue or cease the air flow to the pneumatic therapy device in response to the presence determination.

The algorithm as shown in FIG. 7 includes determining/pre-programing main controller 18 with the desired therapy and pressure to be applied to the patient upon identification of the presence of conduit 110 by sensors 64. The initial presence of conduit 110 at port 15 is determined at step 301 by sensors 64 and main controller 18. Step 302 includes monitoring sensors 64 for presence of conduit 110. Sensors 64 are configured to determine the presence of conduit 110 at port 15 and convey a signal to main controller 18 and/or air system, controller 62. In some embodiments, when the signal from sensors 64 is conveyed to air system controller 62, air system controller 62 is configured to communicate the signal to main controller 18. Illustratively, main controller 18 is configured to interpret the signal from sensors 64 and determine the presence or absence of conduit 110 at port 15, at step 303. At step 304, if the signal indicates the presence of conduit 110, then main controller 18 communicates to air system controller 62 to initiate the pre-programmed therapy and pressure assigned in step 301. At step 304, if conduit 110 is not present at port 15 then air flow to SCD assembly 14 is stopped by instructions from main controller 18 to air system controller 62. At step 305, the signals from sensors 64 and initiation of therapy by main controller 18 and air system controller 62 are recorded. In some embodiments, step 306 is further included and comprises alerting the caregiver of the decoupling of conduit 110 from port 15. Optionally, only one of steps 305 or 306 may be completed. Illustratively, upon main controller 18 determining the removal of conduit 110 from port 15, the pressurized air flow to SCD assembly 14 is stopped by main controller 18 in communication with air system controller 62 and the caregiver is alerted of the violation, thereby completing steps 305 and 306.

Main controller 18 is, therefore, illustratively configured to automatically communicate to air system controller 62 to stop therapy in response to a signal from sensors 64 conveying a disconnection of conduits 110 and ports 15. Similar to the algorithm described above and shown in FIG. 7, sensors 64 are in communication with main controller 18 and configured to convey data concerning conduit 110. A distinction between the algorithms concerns the identification of the removal of conduit 110 from port 15 rather than the presence of conduit 110. As such, both measurements may be determined in a single step due to the integral relationship of the presence/absence of conduit 110 at port 15. In some embodiments, sensors 64 are configured to determine the removal of conduit 110 from port 15 and signal to air system controller 62 the removal of conduit 110, at step 303. Air system controller 62 then stops the creation/conveyance of pressurized air flow to SCD assembly 14, at step 304, thereby removing main controller 18 from the method in this additional embodiment.

As discussed above, when SCD assembly 14 is coupled to air system 20, air system 20 senses the presence of SCD assembly 14 and begins the transmission of power and/or pressurized air between SCD assembly 14 and air system 20. Illustratively, such transmission of pressurized air is conveyed through a wired connection to SCD assembly 14. Whereas the transmission of power may be completed wirelessly, illustratively. In other embodiments, the transmission of power may be conveyed through a wired connection. In some embodiments, air system 20 continuously generates the pressurized air stream upon coupling to SCD assembly 14, thereby causing SCD assembly 14 to maintain a desired level of pressure within SCD assembly 14. In other embodiments, air system 20 is pre-programmed to generate pressurized air in cycles, waves, and/or any other desired patterns. In still other embodiments, main controller 18 and air system 20 are in communication such that air system 20 is configured to move between a plurality of pre-programmed patterns in response to user input or automatically in response to sensed pressure values of SCD assembly 14 exceeding a predetermined threshold. Main controller 18, sensors 64, and air system 20 are in communication and further configured to identify the removal of the SCD assembly 14 and, illustratively, stop production of the pressurized air stream within the air system 20.

Therefore, upon identification of SCD assembly 14 coupling to air system 20, air system 20 communicates such coupling to main controller 18. Main controller 18 is configured to communicate with user interface 70 such that user interface 70 is updated to control operation of SCD assembly 14 by allowing access to air system 20 via user interface 70. Such access allows for a caregiver to input/receive patient data at a centralized location on patient support apparatus 12. Illustratively, user interface 70 is configured to alert the caregiver upon disconnection of SCD assembly 14 and air system 20 and/or other interruptions to the therapy therein provided.

In further embodiments, conduit 110 is formed as a pneumatic conduit and is made of an elastic, non-porous material configured to expand in length when pressurized with air. Such elastic, non-porous material is configured to move between an extended length (not shown) and a storage length (not shown) in response to the presence of pressurized air therein. Storage length has a distance measuring less than a distance of extended length, and, as such, storage length has a surface area measuring less than a surface area of extended length. At rest, pneumatic conduit has the storage length. Upon actuation of source of pressurized air 58, pneumatic conduit reacts to the presence of pressurized air by increasing the length and surface area of pneumatic conduit. As such, so long as the pressurized air is directed into pneumatic conduit, pneumatic conduit will maintain the extended length. Therefore, a production and direction of the majority of the pressurized air into conduit is to be ceased before conduit returns to storage length. This permits conduit to be stored in a variety of manners due to the decreased length and surface area of conduit.

In other embodiments in which conduit 110 is formed as a pneumatic conduit, pneumatic conduit is configured to include a break away port (not shown). Break away port may be positioned between sleeve 108 and conduit 110 and/or between a first conduit section extending between sleeve 108 and break away port and a second conduit section extending between break away port and second end of conduit. Break away port is configured to disconnect from conduit 110 when longitudinal forces in line with conduit 110 exceed a pre-determined breaking force of port. The force needed to decouple port and conduit 110 is substantially greater than the longitudinal force created by the pressurized air within conduit 110 during operation of SCD assembly 14 and/or other therapies. As such, actuation of SCD assembly 14 does not cause port to break away from conduit 110 unless such force exceeds the breaking force of port. Further, the breaking force is substantially less than the force exerted upon conduit 110 by a leg of the patient when conduit 110 creates a fall risk. Break away port, therefore, is configured to break away from conduit 110 in response to the patient tripping over conduit 110, thereby resulting in a cessation of therapy until port is reattached to conduit 110. As such, upon main controller 18 ceasing production of pressurized air and the caregiver removal of SCD assembly 14, SCD assembly 14 is decoupled from mattress 22 and necessitates a storage location.

Figure 8:
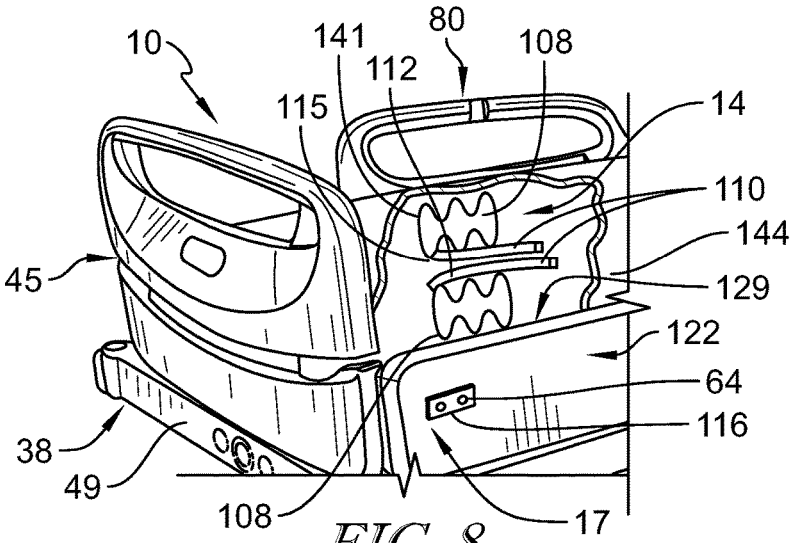
FIG. 8 is a perspective view of an alternative embodiment of the foot section of the support surface shown in FIG. 1 showing a storage section integrally formed within the foot section of the support surface and configured to store the pneumatic therapy device.

Upon termination of therapy and/or decoupling of SCD assembly 14, SCD assembly 14 is configured to be stored between uses. As shown in FIG. 8, mattress 122 may be formed to have a storage section 129 in foot section 144 of mattress 122 sized to store sleeves 108 and conduits 110 therein. Illustratively, storage section 129 is positioned below a bladder (not shown) and/or a foam support (not shown) such that SCD assembly 14 is accessible when a patient is not positioned on mattress 22. In other embodiments, storage section 129 is positioned such that it may be accessed when the patient is positioned on mattress 22. In further embodiments, a storage pocket 231 may be formed in an edge 261 of foot section 244 of mattress 222, as shown in FIG. 9. Storage pocket 231 is sized to store SCD assembly 14 and may be accessed when a patient is positioned on mattress 222. Storage section 129 and storage pocket 231 may be formed in a single mattress (not shown) such that bed 12 is formed to have two storage options 129, 231.

Figure 10:
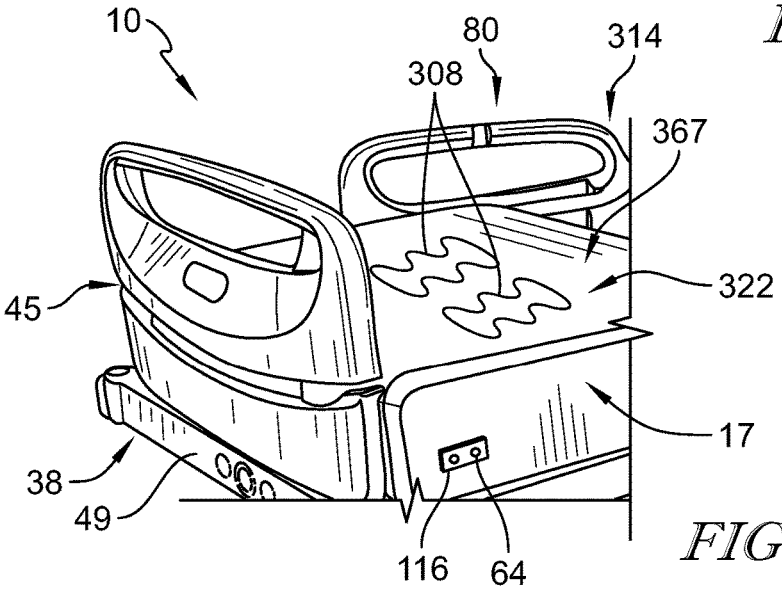
FIG. 10 is a perspective view of an alternative embodiment of the foot section of the support surface shown in FIG. 1 showing a pair of compression sleeves integrally formed within the support surface.

In another contemplated embodiment, as shown in FIG. 10, a portion of SCD assembly 314 is integrally formed in a patient support surface 367 of mattress 322 such that sleeves 308 and conduits 110 are accessible when a patient is positioned on mattress 322. Sleeves 308 are configured to remain coupled to mattress 322 at all times. In other embodiments, SCD assembly 314 may be configured to removeably couple to mattress 322 using a coupling mechanism (i.e.: hook and loop, etc.) (not shown) such that sleeves 308 remain coupled to and positioned on support surface 367 of mattress 322 until removed from mattress 322 by the caregiver. In such an embodiment, sleeves 308 may be coupled and uncoupled from mattress 322 as many times as desired by the caregiver until the coupling mechanism fails to couple SCD assembly 314 to mattress 322

Figure 11:
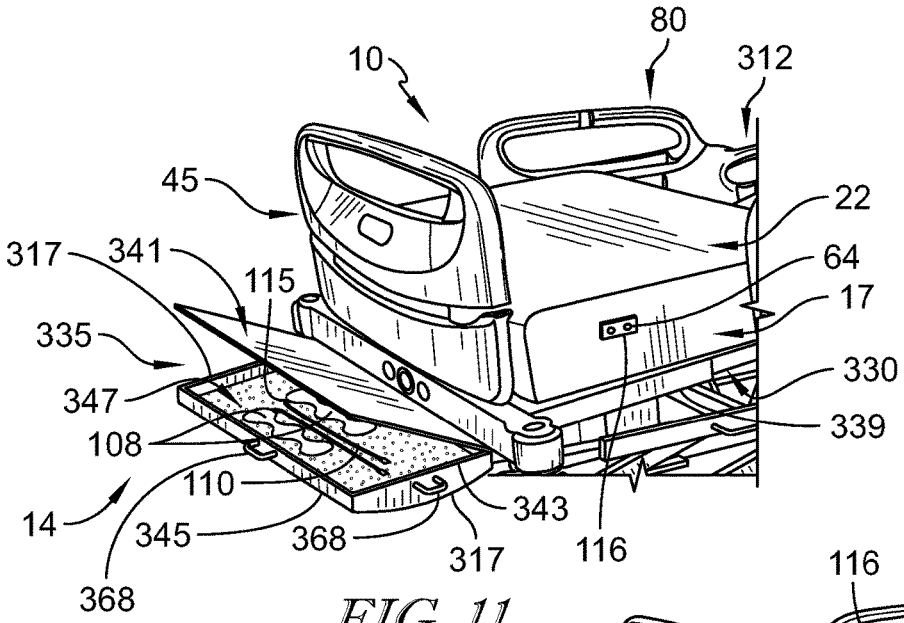
FIG. 11 is a perspective view of an alternative embodiment of the foot section of the support surface shown in FIG. 1 showing a storage drawer movably coupled to a foot end of the frame of the bed and in a foot end, open position.
Figure 12:
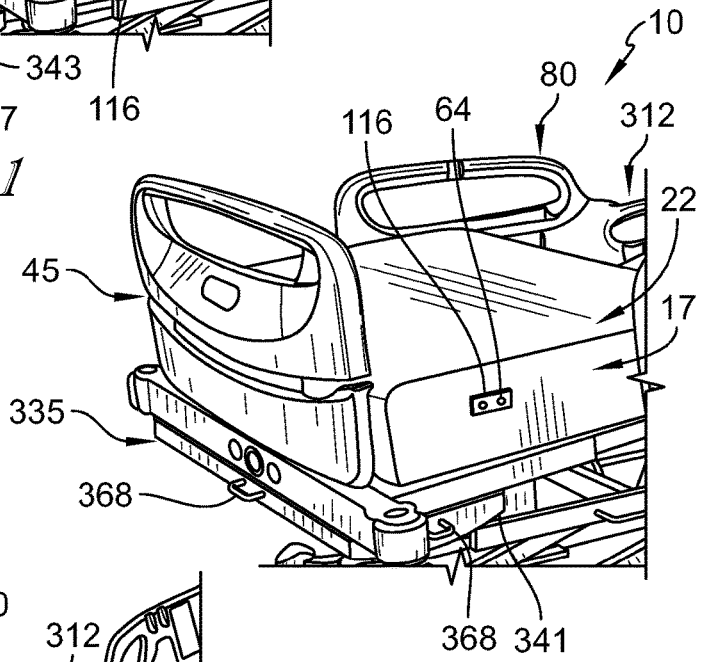
FIG. 12 is a perspective view of the foot section of FIG. 11 showing the storage drawer in a closed position and accessible by a caregiver from the foot end of the bed and/or either of the lateral sides of the bed.
Figure 13:
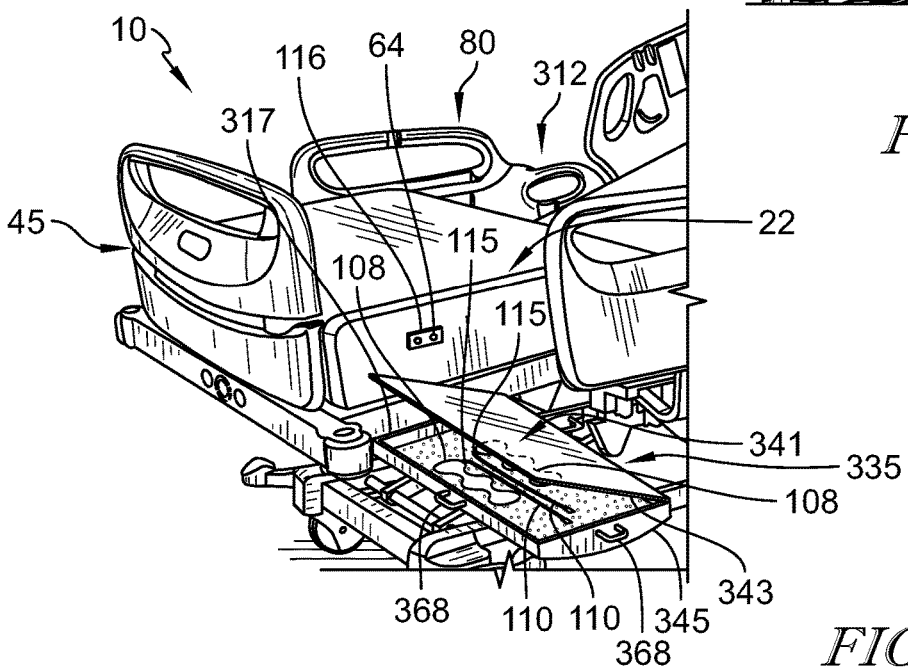
FIG. 13 is a perspective view of the foot section of FIGS. 11 and 12 showing the storage drawer in a left lateral side, open position.

In some embodiments, bed 312 further includes a storage drawer 335 fixedly coupled to foot end 339 of upper frame assembly 330 and positioned below footboard 45, as shown in FIGS. 11-13. As such, storage drawer 335 is configured to store SCD assembly 14 and move between a foot end open position, as shown in FIG. 11, a closed position, as shown in FIG. 12, and a lateral side open position, as shown in FIG. 13. When in the open position, storage drawer 335 may be accessed by a caregiver from foot end 339 and/or either side 17 of bed 312. When in the closed position, storage drawer 335 is concealed and cannot be assessed by the caregiver. Illustratively, storage drawer 335 is formed to include rollers/slides (not shown) configured to allow storage drawer 335 to move between positions as well as be accessed from a plurality of locations (i.e.: foot end 339, either side 17 of bed 312). Storage drawer 335 is further formed to include a lid 341 coupled to an upper section 343 of storage drawer 335 and configured to prevent fluids and/or other contaminants from entering storage drawer 335 and contaminating SCD assembly 14. Storage drawer 335 is also formed to include a bottom 345 spaced apart from lid 341 and a pair of sides 317 extending laterally therebetween. Bottom 345 is formed to have apertures 347 configured to allow cleaning agents to drain from storage drawer 335. Illustratively, sides 317 are formed to include at least one handle 368 configured to be grasped by the caregiver and respond to such caregiver actuation that it moves storage drawer 335 between the open and closed positions. Illustratively, upon moving storage drawer 335 into open position, lid 341 is configured to automatically open and allow immediate access by the caregiver. Automatic opening of lid 341 may be accomplished by using a spring mechanism (not shown) biased towards an access position, as shown in FIGS. 11 and 13, or any other biasing mechanism known in the art. In some embodiments, storage drawer 335 is positioned at head end (not shown) of bed 312 and is configured to be accessible from head end (not shown) and/or sides 17.

Figure 14:
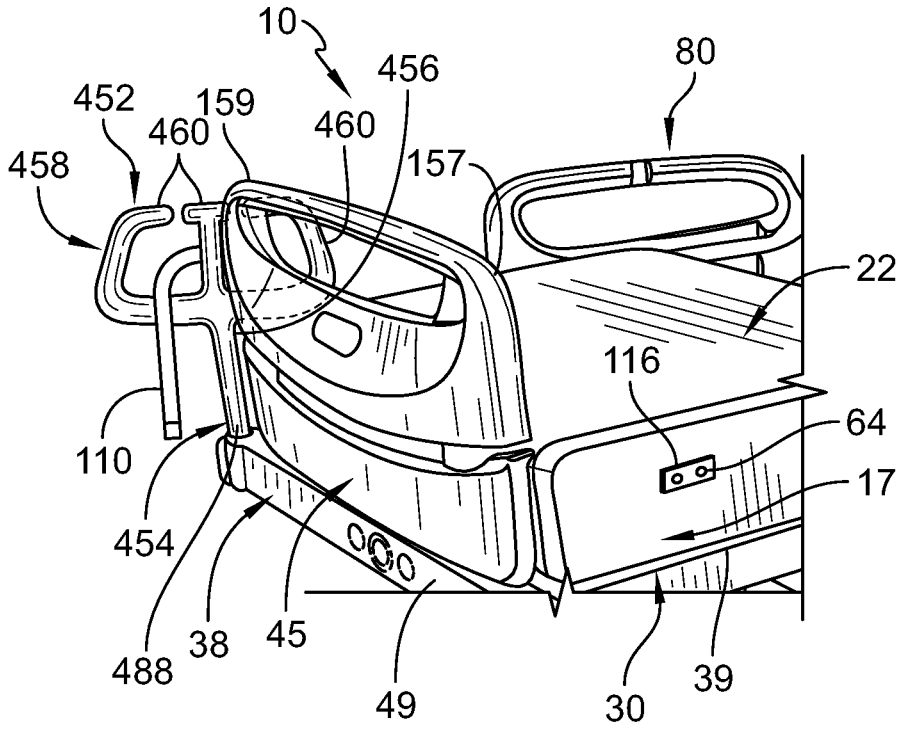
FIG. 14 is a perspective view of an alternative embodiment of the foot section of the bed of FIG. 1 further including a conduit storage device independent of the footboard and configured to support the conduit(s) and/or sleeves of the pneumatic therapy device.

In some embodiments and as shown in FIG. 14, SCD assembly 14 may also be stored utilizing a conduit storage device 452 independent of and removeably coupled to footboard 45. Illustratively, conduit storage device 452 is configured to receive and store conduits 110 such that conduits 110 extend downwardly away from conduit storage device 452 and are positioned adjacent to footboard 45. Conduit storage device 452 may be embodied as an IV pole as shown in FIG. 14 and is configured to move between a storage position (not shown) and an active position as shown in FIG. 14. Conduit storage device 452 is formed to include a first end 488, a second end 456 spaced apart from first end 488, a body 454 extending therebetween, and a head 458 coupled to second end 456 and is configured to removeably couple to foot end 49 of upper frame assembly 38 of bed 12 at first end 488. First end 488 is sized to engage a conduit storage device holder 490 formed in foot end of upper frame assembly 38 of bed 12. Head 458 is formed to have at least one retention extension 460 extending upwardly away from second end 456 and configured to secure and/or engage conduits 110.

Figure 15:
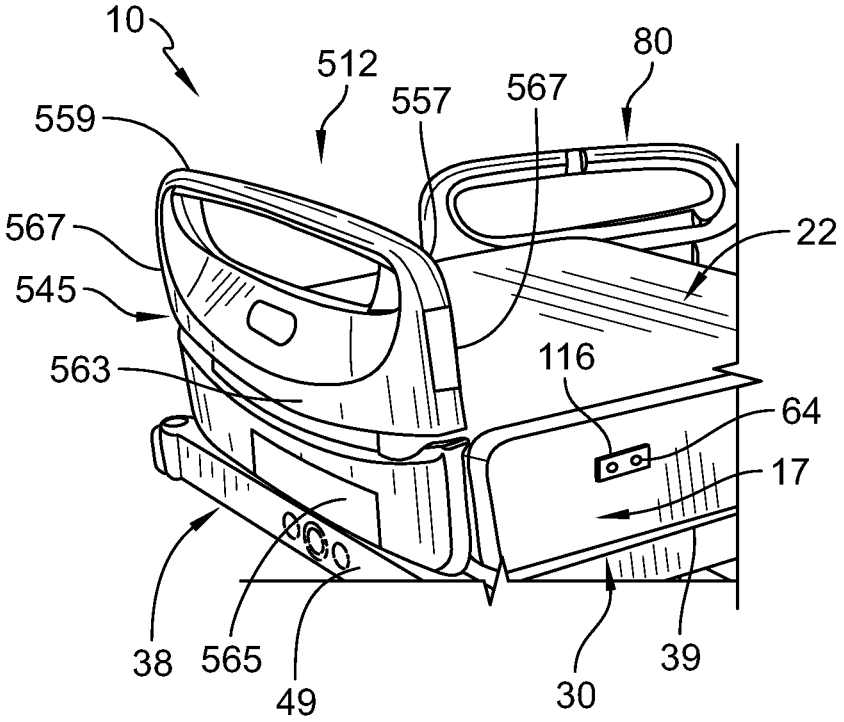
FIG. 15 is a perspective view of an alternative embodiment of the footboard shown in FIG. 1 showing a front access panel and a side access panel formed therein and configured to be removed such that a hollow interior of the footboard is exposed.

Conduit storage device 452 is further configured to move between a first position (not shown) at a first edge 159 of foot end 49 of upper frame assembly 38 of bed 12 and a second position (as shown in FIG. 15) at a second edge 159 of footboard 45. Illustratively, conduit storage device 452 is independent of footboard 45 and, as such, is moveable between a multitude of patient support apparatuses having a variety of footboard designs. Further, two conduit storage devices 452 may be used simultaneously. One of the two conduit storage devices 452 is positioned at the first position and the second conduit storage device 452 positioned at the second position, illustratively. In some embodiments, conduit storage device(s) 452 may be positioned at any location between the first position and the second position. Conduit storage device 452 is additionally configured to engage an IV socket (not shown) formed in footboard 45 and/or foot end 39 of upper frame assembly 30. Further, in some embodiments, conduit storage device 452 is removeably coupled to headboard 46 of bed 12.

In further embodiments, footboard 545 of bed 512 may be formed to include a hollow interior (not shown) sized to store SCD assembly 14, as shown in FIG. 15. Thus, SCD assembly 14 is completely hidden from view when footboard 545 is in a closed position, as shown in FIG. 15. The hollow interior is further configured to be accessible by the caregiver upon the caregiver exposing the hollow interior whether or not a patient is positioned on mattress 22. As such, SCD assembly 14 may be placed therein and removed therefrom without disturbance of the patient. Illustratively, footboard 545 is formed to include first edge 557, second edge 559 spaced apart from first edge 557, and a body 563 extending therebetween. In some embodiments, body 563 is formed to include a face access panel 565 configured to allow access into the hollow interior. In other embodiments, footboard 545 is formed to include an edge access panel 567 positioned at first edge 557 or second edge 559 and configured to provide access into the hollow interior. Body 563 may be formed to include two edge access panels 567 such that the hollow interior is accessible from either edge 557, 559 of footboard 545. Body 563 may further be formed to include face access panel 565 in conjunction with edge access panel 567 positioned at first edge 557, second edge 559, or both. Thus, the hollow interior is configured to receive SCD assembly 14 through an opening (not shown) formed by removing one of panels 565, 567 from blocking access therein. Panels 565, 567 are, therefore, configured to move between a closed position blocking access to the hollow interior (FIG. 15) and an open position (not shown) allowing access to the hollow interior. Further, SCD assembly 14 may be stored within the hollow interior upon being placed within a vacuum-pack (not shown) to reduce the storage space required therein. In addition, SCD assemblies 14 not configured to utilize air system 20 of bed 12 may also include an SCD air pump (not shown) configured to provide pressurized air to conduits 110 and sleeves 108 and formed to be stored within the hollow interior of footboard 545.

Figure 16:
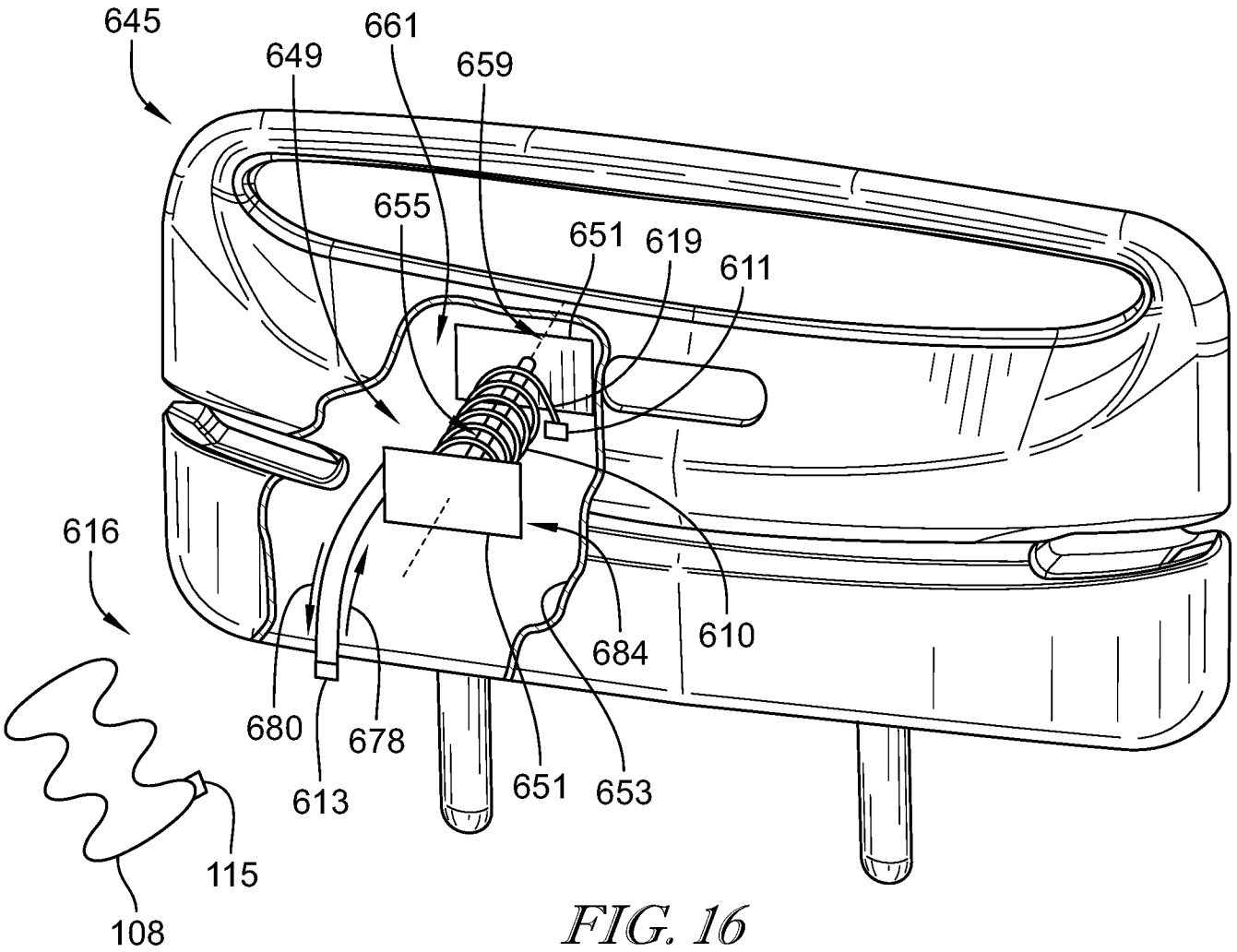
FIG. 16 is a perspective elevation view of an alternative embodiment of the footboard shown in FIG. 1 further including an automatic retractor mechanism configured to couple to the pneumatic therapy device, and the pneumatic therapy device is configured to move between a conduit lengthening direction away from the footboard and a conduit shortening direction towards the footboard.
Figure 17:
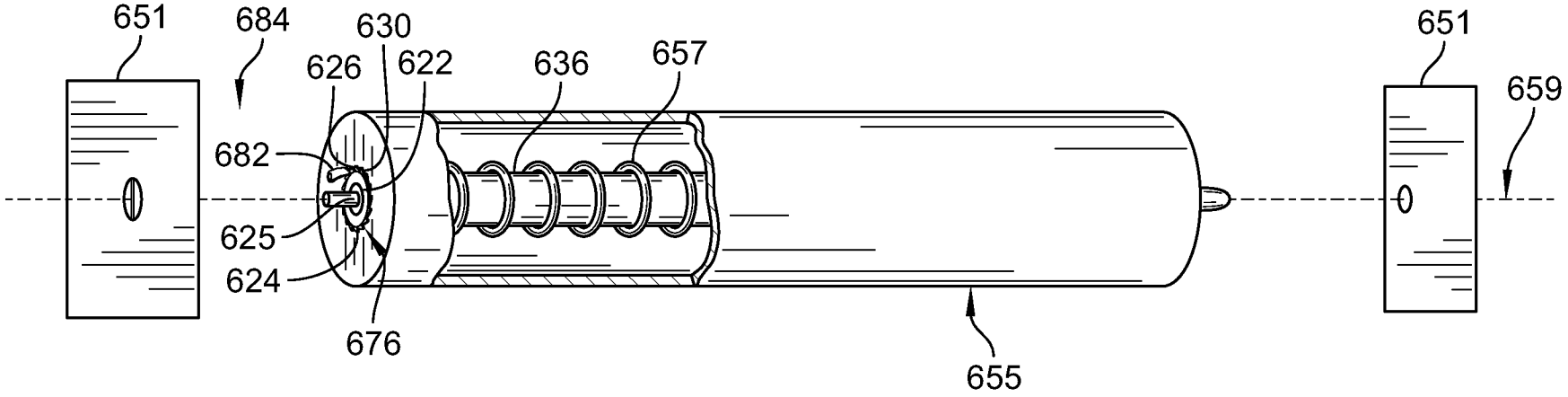
FIG. 17 is an exploded view of the ratchet assembly of the automatic retractor mechanism of FIG. 16 with a break away section showing a rotary spring configured to bias the automatic retractor mechanism in the conduit shortening direction.

Referring to FIGS. 16 and 17, in other embodiments, footboard 645 is formed to include a hollow interior 661 configured to house conduit(s) 610 and a conduit retractor mechanism 649 adapted to permit extension of conduit 610 from within footboard 645 such that conduit 610 may be detachably coupled to sleeve 108. In this embodiment, conduit 610 is formed to include an air source port 611 at a second end 619 of conduit 610 that is configured to couple conduit 610 to a source of pressurized air (not shown) coupled to bed (not shown). Conduit 610 is further formed to include a conduit port 613 at first end of conduit 610 configured to couple to sleeves 108. As such, conduit 610 is configured to extend between air source and sleeve(s) 108 and cooperate with conduit retractor mechanism 649 to move between a conduit-lengthening direction 680 and a conduit-shortening direction 678.

Conduit retractor mechanism 649 includes a ratchet 676 to selectively permit movement of conduits 610 relative to footboard 645 between conduit-shortening direction 678 and conduit-lengthening direction 680, as shown in FIG. 17. Illustratively, a caregiver actuates a pawl 682 to move a ratchet 676 to a latched or actuated position such that conduit 610 is inhibited from moving relative to footboard 645 in a conduit-shortening direction 678, but uncoiling of conduit 610 in conduit-lengthening direction 680 is permitted. Together, ratchet 676 and pawl 682 form a ratchet assembly 684. Ratchet assembly 684 is configured to move between a locked position (as shown in FIG. 17) and a release position (not shown). Movement of ratchet assembly 684 between the locked position and the release position is accomplished by actuation of a release (not shown) by a caregiver. The release cooperates with ratchet assembly 684 to move pawl 682 out of engagement with ratchet 676. In some contemplated embodiments, the release may be embodied as a button, lever, other release device known in the art, or some combination thereof.

Conduit retractor mechanism 649 maintains the extended length of conduit 610 by blocking movement of ratchet assembly 684 in the conduit-shortening direction 678 such that conduit 610 is blocked from returning into hollow interior 661. As such, conduit 610 is lengthened/uncoiled by pulling conduit 610 away from footboard 645. Conduit retractor mechanism 649 is configured to retract conduit 610 upon moving ratchet assembly 684 to the release position (not shown). Conduit retractor mechanism 649 includes a pair of brackets 651, one of which is coupled to an inner surface 653 of footboard 645. Bracket 651 rotatably supports a spool 655 about which conduit 610 is coiled or wound. A biasing member 657, illustratively a torsion or rotary spring, is coupled to spool 655 and footboard 645 to bias spool 655 in conduit-shortening direction 678 about an axis 659 extending longitudinally through spool 655, as shown in FIGS. 16 and 17. Thus, conduit 610 is biased in conduit-shortening direction 678.

As mentioned above and shown in FIG. 17, conduit retractor mechanism 649 further includes ratchet 676 to selectively restrict movement of spool 655. Ratchet 676 includes a wheel 622 having teeth 624 projecting radially outwardly around the circumference of wheel 622. Each of the teeth 624 includes a straight surface 626 that lies generally in a plane extending radially from center 625 of wheel 622. Each of teeth 624 includes a sloped surface 630 forming an acute angle with straight surface 626. Wheel 622 includes an opening (not shown) at its center 625 to receive a first end 636 of spool 655 therein. The opening is complementary in shape to first end 636. Wheel 622 is thus mounted on end 636 of spool 655, and secured thereto by a retainer (not shown). When conduit 610 is pulled away from footboard 645 for use, ratchet 676 illustratively permits rotation of spool 655 in the conduit-lengthening direction 680 but inhibits movement in the opposite direction. Once extended, conduit 610 is configured to removeably couple to sleeve 108 via pneumatic connector 115 formed therein and port 613. In preparation to store at least a portion of SCD assembly 616, ratchet assembly 684 is moved to the release position, and the retractor assembly 649, through operation of internal coil spring 657 acting against conduit support spool 655, functions to automatically retract conduit 610 and conduit port 613 to the storage position, as shown in FIG. 16.

Figure 18:
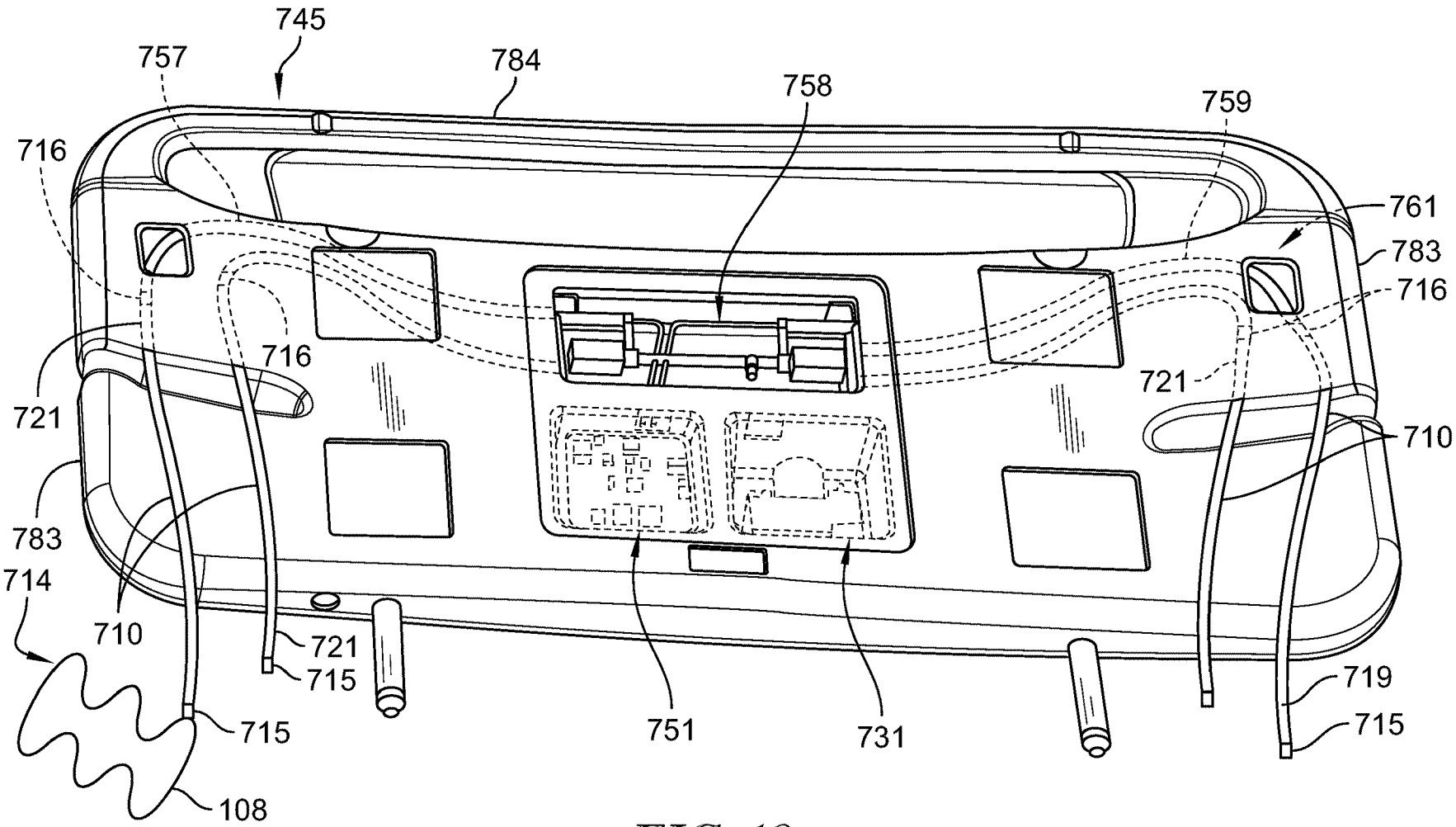
FIG. 18 is an elevation view of an alternative embodiment of the footboard shown in FIG. 1 having a footboard air supply independent of the pressurized air source of the bed and configured to provide pressurized air to the pneumatic therapy device.

In other embodiments of footboard 745, a source of pressurized air 758 is positioned within hollow interior 761 and configured to couple to SCD assembly 714, specifically, conduit 710 via a pneumatic connector 715. As shown in FIG. 18, pneumatic connector 715 is positioned at a second end 719 of conduit 710 and conduit port 713 is positioned at a first end 721 of conduit 710. In some embodiments, additional connectors are provided to couple mattress 22 to source of pressurized air 758 such that mattress 22 may use a power source 751 and a footboard air system 731 positioned within footboard 745.

Figure 19:
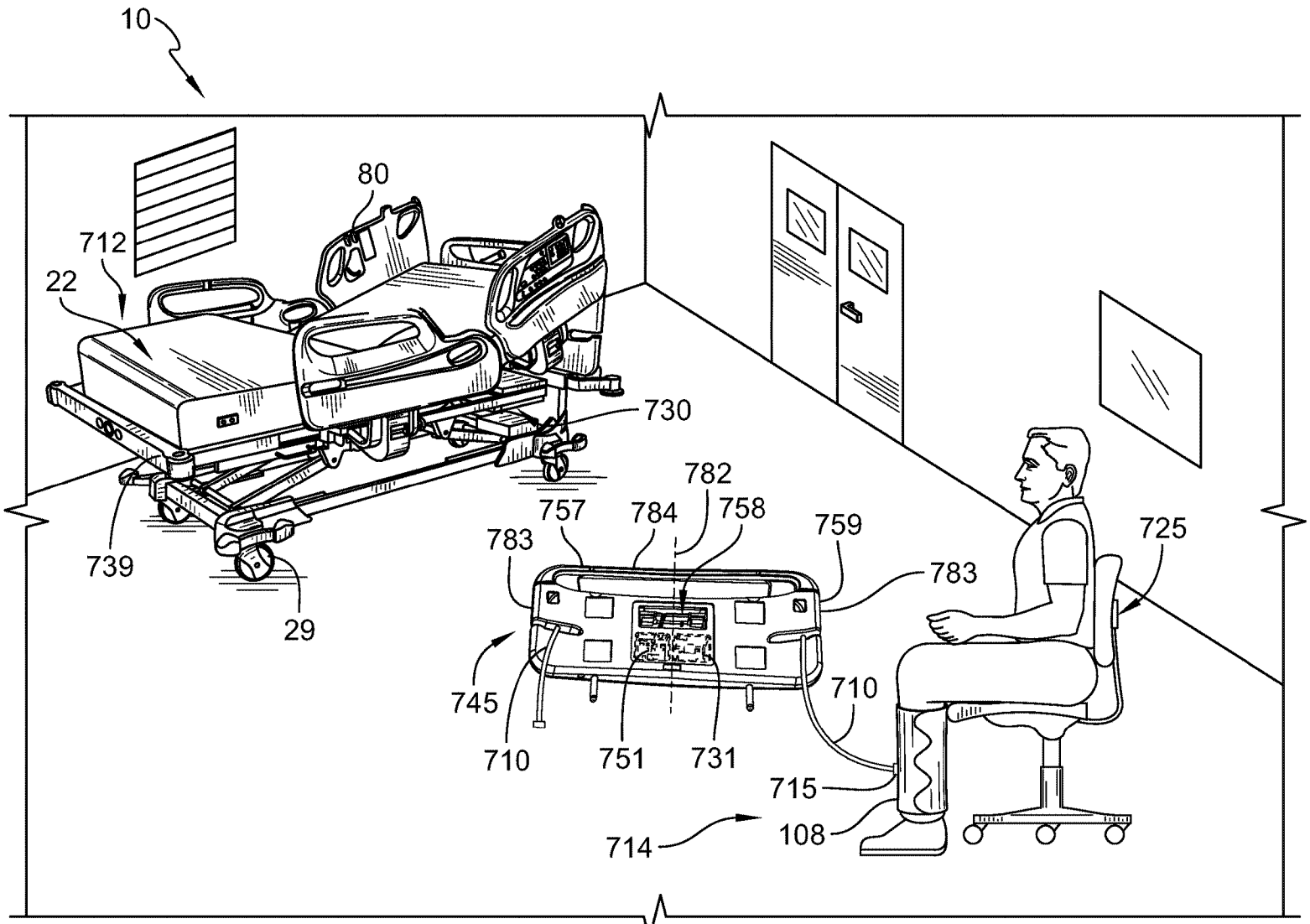
FIG. 19 is a diagrammatic view showing a patient's room with a footboard as shown in FIG. 18 decoupled from the bed and positioned next to a bedside chair in which the patient is sitting.

In some embodiments, footboard 745 is formed to include power source 751, footboard air system 731, and a pair of conduit ports 716 in both first hose 757 and second hose 759, as shown in FIGS. 18 and 19. In other embodiments, ports 716 may be formed in foot end 739 of upper frame assembly 730 and/or sides 757, 759 of and are configured to couple to footboard 745. Illustratively, ports 716 are configured to removeably couple to conduits 710 such that SCD assembly 714 may be positioned at first edge 757 of footboard 745, second edge 759 of footboard 745, or some combination thereof. Ports 716 extend away from the patient positioned on bed 712 and, as such, may be formed in a first edge surface 783 of first edge 757 and/or second edge 759 such that ports 716 extend perpendicular to a central axis 782 of footboard 745. In some embodiments, ports 717 are formed in an outer body surface 784 and extend away from the patient, parallel to central axis 782. Illustratively, ports 717 are configured to receive two SCD assemblies 716 such that both assemblies 716 are positioned at a first edge and/or second edge 783. Ports 717 are further configured to removeably couple to a plurality of other devices to provide additional therapy and/or increase patient comfort. As such, SCD assembly 714 and additional therapies may be powered by an air system (not shown) positioned within patient support apparatus (not shown).

Power source 751 and footboard air system 731 are independent of the patient support apparatus. The power source 751 is configured to retain a backup charge having enough energy to provide power to SCD assembly 714 and other therapy devices (not shown) coupled thereto when footboard 745 is removed from the patient support apparatus, as shown in FIG. 19. Illustratively, power source 751 is formed as a battery located within footboard 745. Battery 751 permits removal of footboard 745 from frame 747 such that bed 12 may be positioned in a chair position while avoiding disruption of the patient's therapy. As such, bed 712 is configured to maintain an actuated therapy upon the patient throughout movement of the bed 712 from a prone position, as shown in FIG. 1, and a chair position (not shown). Therefore, in some embodiments, footboard 745 is configured to be removed from bed 712 before bed 712 is moved into the chair position.

The patient support apparatus is further configured to maintain an actuated therapy upon a patient when the patient support apparatus moves between a reclined position and a chair position. As such, the therapy is undisrupted during movement of the patient support apparatus. To maintain a power supply to SCD assembly when footboard 745 is removed, power source 751 is configured to charge wirelessly (i.e.: inductive charging) and/or using a detachable connecter (not shown). Further, footboard 745 is configured to communicate with main controller 18 in both the bed and chair positions. Such communication may be accomplished wirelessly (i.e.: Bluetooth) and/or wired via detachable connector (not shown), illustratively. Additionally, footboard 745 may communicate with main controller 18 through hard wired connections. Footboard 745 may also be used independent of bed 712 as shown in FIG. 19. The patient may be positioned on a chair and/or other patient support surface 725 spaced apart from bed 712 while maintaining the actuated therapy upon the patient as patient moves between bed 712 and chair 725. Once the patient is positioned in chair 725, the caregiver places footboard 745 near the patient such that conduits 710 extend between footboard 745 and sleeve 108.

As such, footboard air system 731 cooperates with power source 751 to provide pressurized air to the SCD assembly when footboard 745 is decoupled from the patient support apparatus. Footboard air system 731 is independent of air system 20 located in the patient support apparatus and, further, may be the sole air source of the patient support apparatus. As such, footboard air system 731 includes a source of pressurized air (not shown), a distribution manifold (not shown), and an air system controller (not shown) in communication with main controller 18, source of pressurized air (not shown), and a distribution manifold (not shown). Footboard air system 731 is substantially similar to air system 20 shown in FIGS. 1-4 and described above. Accordingly, the description of air system 20 is hereby incorporated by reference to apply to footboard air system 731 except as it departs from the further description and drawings of footboard air system 731. As such, footboard 745 is configured to communicate with main controller 18 to actuate SCD assembly 716 and maintain such actuation throughout movement of bed 712 and/or removal of footboard 745 and patient from the patient support apparatus.

Although certain illustrative embodiments have been described in detail above, variations and modifications exist within the scope and spirit of this disclosure as described and as defined in the following claims.

The invention claimed is:

1. A therapy system comprising a patient support apparatus, the patient support apparatus including a frame, a patient support surface supported on the frame, a main controller electrically coupled to a user interface, an air system supported on the frame, the air system including a source of pressurized air, an outlet coupled to the source of pressurized air, and an air system controller in communication with the user interface, the source of pressurized air, and the outlet, the air system controller including a processor, and a memory device, a pneumatic therapy device, a port removeably pneumatically coupling the pneumatic therapy device and the outlet, and a storage structure for storing a portion of the pneumatic therapy device when the pneumatic therapy device is not in use, wherein the port detects a coupling of the pneumatic therapy device and communicates a signal of the coupling to the main controller, the main controller receives the signal, and communicates the signal to the air system controller, and wherein the memory device includes instructions, that, when executed by the processor, causes the air system controller to automatically initiate a pre-programmed therapy using the pneumatic therapy device, and wherein the main controller communicates the signal to the user interface to allow a user to control operation of the pneumatic therapy device from the user interface.

2. The therapy system of claim 1, wherein the air system controller detects a removal of the pneumatic therapy device from the outlet and signals the main controller to update the user interface to reflect removal of the pneumatic therapy device.

3. The therapy system of claim 2, wherein the pneumatic therapy device draws power from a power supply of the patient support apparatus to operate the pneumatic therapy device and the air system, the air system simultaneously provides pressurized air to both the patient support apparatus and the pneumatic therapy device.

4. The therapy system of claim 3, wherein the air system controller controls the flowrate of the pressurized air between the source of pressurized air, the patient support apparatus, and the pneumatic therapy device.

5. The therapy system of claim 4, wherein the air system further includes a valve coupled to the outlet and removeably coupleable to the pneumatic therapy device, the valve controls the flowrate of the pressurized air between the air system and the pneumatic therapy device.

6. The therapy system of claim 1, wherein the port is independent of both the pneumatic therapy device and the outlet, the port engageable with a first pneumatic therapy device coupled to a first patient support apparatus, disengageable from the first pneumatic therapy device, and engageable with a second pneumatic therapy device coupled to a second patient support apparatus.

7. The therapy system of claim 1, wherein the pneumatic therapy device is a sequential compression device (SCD) assembly.

8. The therapy system of claim 1, the pneumatic therapy device further comprising at least one therapy sleeve operable to engage an occupant, and at least one hose having a first end, and a second end spaced apart from the first end, wherein the at least one hose is removeably coupled to the at least one therapy sleeve at the first end of the at least one hose and to the port at the second end of the at least one hose, the at least one hose further directing a pressurized airstream from the air system to the at least one therapy sleeve.

9. The therapy system of claim 8, wherein the port detects the removal of the at least one therapy sleeve from the port and communicates a signal of the removal of the at least one therapy sleeve to the main controller of the patient support apparatus, the main controller receives the signal and terminates operation of the therapy system.

10. The therapy system of claim 8, wherein the port detects the coupling of the at least one hose from the port and communicates a signal of the coupling to the main controller of the patient support apparatus, the main controller receives the signal and commences operation of the therapy system, and wherein the main controller is configured to measure, record, and adjust pressure of the pneumatic therapy device automatically at periodic intervals.

11. The therapy system of claim 9, wherein the main controller is operable to automatically commence therapy upon receiving the signal of the coupling of the at least one hose to the port.

12. The therapy system of claim 8, wherein the patient support surface is formed to integrally include the at least one therapy sleeve therein.

13. The therapy system of claim 8, wherein the patient support surface is formed to integrally include a pocket, the pocket formed to house the pneumatic therapy device and be accessed by a caregiver while the occupant is located on the patient support apparatus.

14. The therapy system of claim 10, wherein the patient support surface is formed to include a head end, a foot end spaced apart from the head end, a first edge extending perpendicular to and from the head end to the foot end, a second edge extending perpendicular to and from the head end to the foot end and spaced apart from the first edge such that a body section is positioned therebetween, and the body section extending longitudinally between the head end and the foot end and laterally between the second edge and the first edge, wherein the frame includes a footboard positioned at the foot end of the patient support surface and extending between the second edge and the first edge of the patient support surface, the footboard formed to house the air system therein.

15. The therapy system of claim 14, wherein the footboard is formed to have a plurality of ports with an at least one of the plurality of ports positioned at the second edge and an at least one of the plurality of ports positioned at the first edge, the plurality of ports extending away from the patient support surface and couples to the at least one therapy sleeve.

16. The therapy system of claim 14, wherein the footboard includes a battery to provide power to the therapy system independent of the power from the patient support apparatus and to the therapy system when the patient support apparatus is in a relined position, a seated position, or any position therebetween.

17. The therapy system of claim 16, wherein the footboard is removeable from the patient support apparatus without disrupting the therapy provided to the occupant located in the patient support apparatus.

18. The therapy system of claim 15, wherein the therapy system is operable with a single hose coupled to a single port, a plurality of hoses coupled to a plurality of ports simultaneously, and a plurality of hoses coupled to a plurality of ports selectively.

19. The therapy system of claim 18, wherein the plurality of hoses include an alternative therapy device operable to cooperate with the pneumatic therapy device to treat the occupant supported on the patient support apparatus.

20. The therapy system of claim 14, wherein the footboard is formed to include a storage space therein to house the pneumatic therapy device, and an access panel moveable between an open position in which the pneumatic therapy device is accessible by a caregiver and a closed position in which the pneumatic therapy device is blocked from view and inaccessible by the caregiver.

21. A therapy system comprises a patient support apparatus including an integrated air system and a user interface, the patient support apparatus including an air distribution system operable to direct air from the air system to a pneumatic therapy device, the user interface operable to provide a graphical user interface for a caregiver to control the operation of the integrated air system to vary the operation of the pneumatic therapy device, the patient support apparatus is adapted to store the pneumatic therapy device when the pneumatic therapy device is not in use, and the patient support apparatus is operable to detect the pneumatic therapy device and automatically start a preprogrammed therapy when the pneumatic therapy device is coupled for use with the patient support apparatus.

22. The therapy system of claim 21, wherein the patient support apparatus includes a mattress, the mattress including a port for connecting a conduit for the pneumatic therapy device to the air distribution system and including a storage section adapted to store the pneumatic therapy device within the mattress when the pneumatic therapy device is not in use.

23. The therapy system of claim 22, wherein the mattress includes a storage space in the body of the mattress for storing the pneumatic therapy device.

24. The therapy system of claim 23, wherein the mattress includes a storage pocket formed on an edge of the mattress.

25. The therapy system of claim 22, wherein the mattress includes a storage pocket formed on an edge of the mattress.

26. The therapy system of claim 21, wherein the patient support apparatus includes a storage drawer coupled to a frame assembly of the patient support apparatus.

27. The therapy system of claim 26, wherein the storage drawer is movable to extend from a longitudinal end of the frame assembly.

28. The therapy system of claim 27, wherein the storage drawer is movable to extend from a lateral side of the frame assembly.

29. The therapy system of claim 28, wherein the storage drawer further comprises a lid.

30. The therapy system of claim 21, wherein the patient support apparatus includes a conduit storage device that is configured as an IV pole positioned on a frame assembly of the patient support apparatus, the conduit storage device including a retention extension for securing conduits stored on the conduit storage device.

31. The therapy system of claim 21, wherein the patient support apparatus includes a footboard with a storage space for storing pneumatic therapy devices in the storage space in the footboard.

32. The therapy system of claim 31, wherein the footboard includes a conduit retractor mechanism adapted to permit extension of a conduit from within the footboard.

33. The therapy system of claim 32, wherein the conduit retractor mechanism supports a conduit that includes a first end coupleable to an outlet of the air distribution system and a second end coupleable to a sleeve of the pneumatic therapy device, while the conduit is supported on the conduit retractor mechanism.

34. The therapy system of claim 21, wherein the patient support apparatus includes a conduit retractor mechanism adapted to permit extension of a conduit from within the footboard.

35. The therapy system of claim 34, wherein the conduit retractor mechanism supports a conduit that includes a first end coupleable to an outlet of the air distribution system and a second end coupleable to a sleeve of the pneumatic therapy device, while the conduit is supported on the conduit retractor mechanism.

36. The therapy system of claim 21, wherein the patient support apparatus includes a footboard that is formed to have a plurality of ports with an at least one of the plurality of ports positioned at the second edge and an at least one of the plurality of ports positioned at the first edge, the plurality of ports extending away from the patient support surface and couples to a therapy sleeve of the pneumatic therapy device.

37. The therapy system of claim 21, wherein the patient support apparatus includes a footboard that includes a battery to provide power to the therapy system independent of the power from the patient support apparatus and to the therapy system when the patient support apparatus is in a reclined position, a seated position, or any position therebetween.

38. The therapy system of claim 37, wherein the footboard is removeable from the patient support apparatus without disrupting the therapy provided to a patient located in the patient support apparatus.

39. A therapy system comprises a patient support apparatus including an integrated air system and a user interface, the patient support apparatus including an air distribution system operable to direct air from the air system to a pneumatic therapy device, the user interface operable to provide a graphical user interface for a caregiver to control the operation of the integrated air system to vary the operation of the pneumatic therapy device, the patient support apparatus is adapted to store the pneumatic therapy device when the pneumatic therapy device is not in use, wherein the patient support apparatus includes a footboard with a storage space for storing pneumatic therapy devices in the storage space in the footboard, wherein the footboard includes a conduit retractor mechanism adapted to permit extension of a conduit from within the footboard, wherein the conduit retractor mechanism supports a conduit that includes a first end coupleable to an outlet of the air distribution system and a second end coupleable to a sleeve of the pneumatic therapy device, while the conduit is supported on the conduit retractor mechanism, and wherein the conduit retraction mechanism include a ratchet assembly to allow the conduit supported thereon to be extended to a particular length.

40. The therapy system of claim 39, wherein the conduit retraction mechanism is spring-loaded and a release is actuable to cause the conduit supported on the conduit retraction mechanism to be gathered onto the conduit retraction mechanism inside of the footboard.

41. A therapy system comprises a patient support apparatus including an integrated air system and a user interface, the patient support apparatus including an air distribution system operable to direct air from the air system to a pneumatic therapy device, the user interface operable to provide a graphical user interface for a caregiver to control the operation of the integrated air system to vary the operation of the pneumatic therapy device, the patient support apparatus is adapted to store the pneumatic therapy device when the pneumatic therapy device is not in use, wherein the patient support apparatus includes a conduit retractor mechanism adapted to permit extension of a conduit from within the footboard, wherein the conduit retractor mechanism supports a conduit that includes a first end coupleable to an outlet of the air distribution system and a second end coupleable to a sleeve of the pneumatic therapy device, while the conduit is supported on the conduit retractor mechanism, and wherein the conduit retraction mechanism include a ratchet assembly to allow the conduit supported thereon to be extended to a particular length.

42. The therapy system of claim 41, wherein the conduit retraction mechanism is spring-loaded and a release is actuable to cause the conduit supported on the conduit retraction mechanism to be gathered onto the conduit retraction mechanism inside of the footboard.

* * * * *